US008793111B2

(12) United States Patent
Tilke et al.

(10) Patent No.: US 8,793,111 B2
(45) Date of Patent: Jul. 29, 2014

(54) AUTOMATED FIELD DEVELOPMENT PLANNING

(75) Inventors: Peter Gerhard Tilke, Belmont, MA (US); Vijaya Halabe, Abingdon (GB); Raj Banerjee, Abingdon (GB); Tarek M. Habashy, Burlington, MA (US); Michael Thambynayagam, Sugar Land, TX (US); Jeffrey Spath, Missouri City, TX (US); Andrew J. Carnegie, Kuala Lumpur (MY); Benoit Couet, Belmont, MA (US); William J. Bailey, Somerville, MA (US); Michael David Prange, Somerville, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1053 days.

(21) Appl. No.: 12/356,137

(22) Filed: Jan. 20, 2009

(65) Prior Publication Data

US 2010/0185427 A1 Jul. 22, 2010

(51) Int. Cl.
*G06G 7/48* (2006.01)

(52) U.S. Cl.
USPC ..... 703/10; 703/9; 702/13

(58) Field of Classification Search
CPC ..... E21B 49/00
USPC ..... 175/40
See application file for complete search history.

(56) References Cited

U.S. PATENT DOCUMENTS 5,842,149 A 11/1998 Harrell et al.
5,992,519 A 11/1999 Ramakrishnan et al.
6,233,524 B1 5/2001 Harrell et al.
6,549,854 B1 4/2003 Malinverno
6,775,578 B2 8/2004 Couet
6,853,921 B2 2/2005 Thomas et al.

(Continued)

FOREIGN PATENT DOCUMENTS

EP 1263653 4/2006
EP 1825100 A2 8/2007

(Continued)

OTHER PUBLICATIONS

Narayanan, K., A.S. Cullick, and M. Bennett. "Better Field Development Decisions from Multi-Scenario, Interdependent Reservoir, Well, and Facility Simulations". SPE Reservoir Simulations Symposium, paper SPE 79703. 2003. Houston, Texas, U.S.A.*

(Continued)

*Primary Examiner* — Kamini S Shah
*Assistant Examiner* — Luke Osborne
(74) *Attorney, Agent, or Firm* — Lam Nguyen; Rodney Warfford; Rich Ruble

(57) ABSTRACT

A system for automatically optimizing a Field Development Plan (FDP) for an oil or gas field uses a fast analytic reservoir simulator to dynamically model oil or gas production from the entire reservoir over time in an accurate and rapid manner. An objective function defining a Figure of Merit (FoM) for candidate FDPs is maximized, using an optimization algorithm, to determine an optimized FDP in light of physical, engineering, operational, legal and engineering constraints. The objective function for the Figure of Merit, e.g., net present value (NPV) or total production for a given period of time, relies on a production forecast from the fast analytic reservoir simulator for the entire FDP.

21 Claims, 14 Drawing Sheets

(56) References Cited

U.S. PATENT DOCUMENTS

| | | | | |
|---|---|---|---|---|
| 6,912,491 | B1 * | 6/2005 | Van Bemmel | 703/2 |
| 7,069,148 | B2 | 6/2006 | Thambynayagam et al. | |
| 7,181,380 | B2 | 2/2007 | Dusterhoft et al. | |
| 7,337,660 | B2 | 3/2008 | Ibrahim et al. | |
| 7,359,844 | B2 | 4/2008 | Sung et al. | |
| 7,430,501 | B2 | 9/2008 | Feraille et al. | |
| 7,460,957 | B2 | 12/2008 | Prange | |
| 7,512,543 | B2 | 3/2009 | Raghuraman | |
| 7,684,929 | B2 | 3/2010 | Prange et al. | |
| 7,725,302 | B2 | 5/2010 | Ayan et al. | |
| 7,876,705 | B2 | 1/2011 | Gurpinar et al. | |
| 7,966,166 | B2 | 6/2011 | Thambynayagam et al. | |
| 8,073,800 | B2 | 12/2011 | Prange et al. | |
| 8,352,227 | B2 | 1/2013 | Klumpen et al. | |
| 2003/0139916 | A1 | 7/2003 | Choe et al. | |
| 2003/0168257 | A1 | 9/2003 | Aldred et al. | |
| 2003/0225606 | A1 | 12/2003 | Raghuraman et al. | |
| 2004/0220742 | A1 | 11/2004 | Mese et al. | |
| 2004/0268338 | A1 | 12/2004 | Gurpinar et al. | |
| 2005/0096893 | A1 | 5/2005 | Feraille et al. | |
| 2005/0114031 | A1 | 5/2005 | Thambynayagam et al. | |
| 2005/0119911 | A1 | 6/2005 | Ayan et al. | |
| 2006/0151214 | A1 | 7/2006 | Prange et al. | |
| 2007/0112547 | A1 | 5/2007 | Ghorayeb et al. | |
| 2007/0156377 | A1 | 7/2007 | Gurpinar et al. | |
| 2007/0168133 | A1 | 7/2007 | Bennett et al. | |
| 2007/0168170 | A1 | 7/2007 | Thomas | |
| 2007/0285274 | A1 | 12/2007 | Esmersoy | |
| 2007/0294034 | A1 | 12/2007 | Bratton et al. | |
| 2007/0299643 | A1 | 12/2007 | Guyaguler et al. | |
| 2008/0103743 | A1 | 5/2008 | Howell et al. | |
| 2008/0133194 | A1 | 6/2008 | Klumpen | |
| 2008/0179094 | A1 | 7/2008 | Repin et al. | |
| 2008/0300793 | A1 | 12/2008 | Tilke et al. | |
| 2009/0056935 | A1 | 3/2009 | Prange et al. | |
| 2009/0157367 | A1 | 6/2009 | Meyer et al. | |
| 2009/0187391 | A1 | 7/2009 | Wendt et al. | |
| 2009/0192712 | A9 | 7/2009 | Karami | |
| 2009/0260880 | A1 | 10/2009 | Thambynayagam et al. | |
| 2009/0271233 | A1 | 10/2009 | Prange et al. | |
| 2009/0288881 | A1 | 11/2009 | Mullins et al. | |
| 2010/0155142 | A1 | 6/2010 | Thambynayagam et al. | |

FOREIGN PATENT DOCUMENTS

| | | | |
|---|---|---|---|
| EP | 2150683 | A1 | 2/2010 |
| GB | 2405205 | A | 2/2005 |
| WO | 2008/150877 | | 12/2008 |

OTHER PUBLICATIONS

Sarkar, S., Toksöz, M.N., and Burns, D.R.: 2002, .Fluid Flow Simulation in Fractured Reservoirs., Report, Annual Consortium Meeting. MIT Earth Resources Laboratory.*

M. A. Luersen and R. Le Riche "Globalized Nelder-Mead method for engineering optimization", Comput. Struct., vol. 82, pp. 2251 2004.*

Pareto Chart (author unknown), retrieved from http://personnel.ky.gov/nr/rdonlyres/d04b5458-97eb-4a02-bde1-99fc31490151/0/paretochart.pdf, via the wayback machine Feb. 8, 2006, 7 total pages.*

Akaike, Hirotugu; A new look at the statistical model identification, IEEE Transactions on Automatic Control 19 (6), Dec. 1974, pp. 716-723.

Badra, O, Well Placement Optimization in Field Development, SPE 84191, 2003, 9 pages.

Beckner, B.L., Field Development Planning Using Simulated Annealing, SPE 30650. 1995, 13 pages.

Burnham, K.P., Multimodel Inference: Understanding AIC and VIC in Model Selection, Amsterdam Workshop on Model Selection, Aug. 27-29, 2004, 93 pages.

Busswell, G., Generalized Analytical Solution for Reservoir Problems with Multiple Wells and Boundary Conditions, SPE 99288, 2006, 21 pages.

Cullick, A.S., Optimizing multiple-field scheduling and production strategy with reduced risk, SPE 84239, 2003, 12 pages.

Cullick, A.S., Optimal Field Development Planning of Well Locations With Reservoir Uncertainty, SPE 96986, 2005, 12 pages.

Fanchi, J.R., Shared Earth Modeling: Methodologies for Integrated Reservoir Simulations, Butterworth-Heinemann, 306, 2002, pp. 5-11.

Gilchrist, J.P.,Semi-analytical Solution for Multiple Layer Reservoir Problems with Multiple Vertical, Horizontal, Deviated and Fractured Wells, IPTC 11718, 2007, 10 pages.

Gutteridge, P.A., Connected Volume Calibration for Well Path Ranking, SPE 35, 1996, 10 pages.

Güyaguler, B., Optimization of Well Placement in a Gulf of Mexico Waterflooding Project; SPE 63221, 2000, 10 pages.

Guiyaguler, B., Uncertainty Assessment of Well Placement Optimization; SPE 87663, 2004, 9 pages.

Ierapetritou, M.G., A Decomposition Based Approach for Optimal Location of Vertical Wells in American Institute of Chemical Engineering Journal 45 (4), 1999, pp. 844-859.

Rosenwald, G. W., A Method for Determining the Optimum Location of Wells in a Reservoir Using Mixed-Integer Programming, Society of Petroleum Engineering Journal 14 (1), 1974, pp. 44-54.

Santellani, G., "Survival of the Fittest" an Optimized Well Location Algorithm for Reservoir Simulation, SPE 39754, 1998, 7 pages.

Seifert, D., Well Placement Optimization and Risking using 3-D Stochastic Reservoir Modeling Techniques, SPE 35520, 1996, 12 pages.

Tatang, M. A., "An efficient method for parametric uncertainty analysis of numerical geophysical models", Journal of Geophysical Research, 102, D18, 1997, 8 pages.

Yeten, B., Optimization of Nonconventional Well Type, Location and Trajectory, SPE 77565, 2002, 14 pages.

Agarwal, "Real Gas Pseudo-Time—A New Function for Pressure Buildup Analysis of MHF Gas Wells", SPE 8279, SPE Annual Technical Conference and Exhibition, Las Vegas, Nevada, Sep. 23-26, 1979, 12 pages.

Al-Hussainy, et al., "The Flow of Real Gases through Porous Media", JPT, May 1966, pp. 625-636.

Bailey, et al., "Field Optimization Tool for Maximizing Asset Value", SPE 87026, SPE Asia Pacific Conference on Integrated Modelling for Asset Management, Kuala Lumpur, Malaysia Mar. 29-30, 2004, pp. 1-10.

Banerjee, et al., "A Method for Analysis of Pressure Response With a Formation Tester Influenced by Superchanging", SPE 102413, SPE Russian Oil and Gas Technical Conference and Exhibition, SPE International, Moscow, Russia, Oct. 3-6, 2006, pp. 1-7.

Boe, et al., "On Real Time Reservoir Management and Simulation While Drilling", SPE 65149, SPE European Petroleum Conference, Paris, France, Oct. 24-25, 2000, 10 pages.

Bourgeois, D. et al., "Improving Well Placement With Modeling While Drilling", Oilfield Review, Winter 2006, vol. 18, No. 4, retrieved Jul. 14, 2009 from <URL: http://public.slb.com/media/services/resources/oilfieldreview/ors06/win06p20_29.pdf>, pp. 20-29.

Brehm, A. et al., "Pre-Drill Planning Saves Money", E&P, retrieved from http://www.epmag.com/archives, May 1, 2005, pp. 1-3.

Brie, A. et al., "Quantitative Formation Permeability Evaluation from Stonely Waves", SPE 49131, SPE Annual Technical Conference and Exhibition, New Orleans, Louisiana, Sep. 27-30, 1998, pp. 389-400.

Chen, S et al., "A Well Test for In-Situ Determination of Relative Permeability Curves", SPE 96414, SPE Annual Technical Conference and Exhibition, Dallas, Texas USA, Oct. 9-12, 2005, pp. 1-16.

Durlofsky, et al., "Advanced Techniques for Reservoir Simulation and Modeling of Nonconventional Wells", Final Report, Stanford University, Department of Petroleum Engineering, Aug. 20, 2004, 224 Pages.

Hammond, P.S. et al., "Correcting Supercharging in Formation-Pressure Measurements Made While Drilling", SPE 95710, SPE Annual Technical Conference and Exhibition, SPE International, Dallas, Texas USA, Oct. 9-12, 2005, pp. 1-13.

Herron, M.M. et al., "A Robust Permeability Estimator for Siliciclastics", SPE 49301, SPE Technical Conference and Exhibition, SPE International, New Orleans, Louisiana USA, Sep. 27-30, 1998, pp. 777-787.

(56) References Cited

OTHER PUBLICATIONS

Omair, A., "Economic Evaluation of Smart Well Technology", Thesis, Texas A&M University, May 2007, retrieved Jul. 14, 2009 from <URL: http://txspace.tamu.edu/bitstream/handle/1969.1/5931/etd-tamu-2007A-PETE-AIOmair.pdf? sequence=1>, Entire document, 62 pages.

Primera, et al., "Simulation While Drilling: Utopia or Reality?", SPE 99945, 2006 SPE Intelligent Energy Conference and Exhibition, Amsterdam, The Netherlands, Apr. 11-13, 2006, 11 pages.

Raghavan, R., "Well Test Analysis: Wells Producing by Solution Gas Drive", SPE Journal, vol. 16 (4) Aug. 1976, pp. 196-208.

Raghuraman, et al., "Valuation of Technology and Information for Reservoir Risk Management", SPE 86568, SPE, Reservoir Evaluation and Engineering, Oct. 2003, pp. 307-314.

Ramakrishnan, et al., "Water Cut and Fractional Flow Logs from Array Induction Measurements", SPE 36503, SPE Annual Technical Conference and Exhibition, Denver, Colorado USA, Oct. 6-9, 1996, pp. 83-98.

Sakowski, et al., "Impact of Intelligent Well Systems on Total Economics of Field Development", SPE 94672, SPE Hydrocarbon Economics and Evaluation Symposium, Dallas, Texas, Apr. 3-5, 2005, 15 pages.

Smiseth, et al., "DollarTarget-Optimize Trade-Off Between Risk and Return in Well Planning and Drilling Operations", SPE 111693, SPE Intelligent Energy Conference and Exhibition, Amsterdam, The Netherlands, Feb. 25-27, 2008, 12 pages.

Blacic, et al., "Report on Conceptual Systems Analysis of Drilling Systems for 200-m-Depth Penetration and Sampling of the Martian Subsurface", LAUR00-4742, GeoEngineering Group, Los Alamos National Laboratory, Oct. 1, 2000, pp. 1-86.

Box et al., "Factorial Designs at Two Levels", Statistics for Experimenters, 2005, Chapter 5; 5.1-5.3, pp. 173-175.

Ierapetritou et al., Optimal Location of Vertical Wells: Decomposition Approach, AIChE Journal, vol. 45, No. 4, pp. 844-859, Apr. 1999.

* cited by examiner

AUTOMATED FIELD DEVELOPMENT PLANNING

FIELD OF THE INVENTION

The invention relates to oil and gas exploration, and in particular to a system and method for automatically optimizing a Field Development Plan with respect to a selected Figure of Merit (FoM) such as net present value (NPV) or total production output over a period of time.

BACKGROUND OF THE INVENTION

The development of a subsurface oil or gas field generally includes the placement of drilling platforms (or the use of existing platforms), as well as the placement of borehole trajectories and well completions. Determining the correct placement of wells during field development is a crucial step in exploration and production workflow. There are many elements to complicate this process. For example, the geology and geomechanics of the subsurface influence where wells can be placed efficiently and safely. The wells themselves have drilling and construction constraints, such as new wells must avoid existing wells. Constraints also exist at the surface: there may be bathymetric or topographic constraints, legal constraints, and constraints related to existing facilities such as platforms and pipelines. Also, the effects of financial uncertainty over time may impact the viability of different solution options.

A Shared Earth Model (SEM) is a geometrical and material property model of the subsurface for an oil and gas field. The model is shared in the sense that it integrates the work of several experts (geologists, geophysicists, well log analysts, reservoir engineers, etc.). Users can typically interact with the model through various application programs, such as the PETREL® software package offered by the assignee of the present application, Schlumberger Technology Corporation of Sugar Land, Tex. SEM information is often displayed as a three-dimensional, finite element map of the geological subsurface. Ideally, SEM contains all available information about a reservoir, and thus forms the basis to make forecasts and plan future actions. However, to a greater or lesser extent, uncertainty exists in SEM parameter values. While acquiring more measurements can reduce uncertainty, it is important to weigh the cost of data acquisition against the benefits of reducing uncertainty. Examples of physical variables in a Shared Earth Model (SEM) that are normally considered during the process of developing a Field Development Plan are listed below:

i. Reservoir geology
1. Stratigraphy (e.g. facies)
2. Structure (e.g. faults)
ii. Reservoir petrophysics
1. Porosity
2. Saturation
3. Permeability
iii. Reservoir Fluid Properties
1. Level of corrosive gases such as $H_2S$
2. Hydrocarbon compositions
3. Hydrocarbon saturation pressures
4. Acidity of the water Of course, parameter variables can also relate to other aspects of the scenario, such as engineering (existing facilities and the need to avoid collision of new borehole trajectories with existing boreholes), operational (binding contracts, e.g., a contract to drill 20 wells per year), or financial (oil price, facility cost, well drilling, construction and production cost) aspects of the project.

Field Development Plans are normally designed in order to meet various objectives, for example, maximum net present value (NPV) from the oil or gas field, or maximum total production in a given period, or to achieve other goals. A typical Field Development Plan includes platform locations, well or borehole trajectories and capacity, completion type, location and flow rate, and reservoir simulator parameters, for example, oil or gas rate. As mentioned, the field development process requires the consideration of a wide variety of parameter variables which cannot be controlled and may be uncertain in nature, as well as a wide variety of constraints, such as physical, engineering, operational, and financial constraints which have to be accounted for in the final Field Development Plan. For example, there may be legal or physical reasons preventing a drilling platform from being constructed in a specific x-y location. Optimizing the field development decision making process is important because initial field production management strategies may impact the viability of the entire field over both the short and long term horizons.

The complexities in designing a Field Development Plan (FDP) lend themselves to mathematical optimization techniques. In this regard, automated or semi-automated Field Development Planning provides the promise of not only facilitating faster decision making, but also rendering the decision making more reliable inasmuch as candidate choices can be quantitatively evaluated and then selected or rejected. Thus, it is not surprising that there has been a long history of research associated with automated and semi-automated Field Development Planning.

Optimization of the Field Development Plan is a highly combinatorial and non-linear exercise. Early work was based on the mixed-integer programming approaches (Rosenwald et al. 1974; Beckner and Song, 1995; Santellani et al. 1998; Leraperititou et al. 1990). This work principally focuses on vertical wells and simplistic static models. Recently, much work has been published on a technique termed "the hybrid genetic algorithm" (HGA) to develop a Field Development Plan that supports non-conventional (non-vertical) wells and side tracks (e.g., Güyaguler et al. 2000; Yeten et al. 2002; Badra et al. 2003; Güyaguler and Horne 2004). While this technique is relatively efficient, the underlying well model is simplistic: a single well with one vertical segment down to a kickoff depth (heal), then an optional deviated segment extending to the toe. Yet, the sophistication of optimized Field Development Plans based on the hybrid genetic algorithm has grown in the past few years. For example, the time component has been included to support injectors, and uncertainty in the reservoir model is being considered (e.g., Cullick et al. 2003; Cullick et al. 2005).

One of the difficulties in developing a practical automated Field Development System has been the overwhelming computational resources required to accurately and completely model production from candidate Field Development Plans for a given oil or gas field. To date, therefore, systems to optimize the Field Development Planning process have been limited in their use.

SUMMARY OF THE INVENTION

The present invention determines optimal subsurface locations and orientations for well completions as well as the other components of a complete Field Development Plan (FDP) by maximizing an objective function for a Figure of Merit (FoM) of candidate Field Development Plans. The invention allows users to rapidly generate multiple scenarios based on different objectives, geology and financial constraints while taking into account, if desired, the presence of uncertainties and risk aversion.

A key element of the invention is the use a high speed analytical reservoir simulator to forecast oil or gas production in an automated Field Development Planning system. The use of a high speed analytical reservoir simulator provides dynamic modeling of oil or gas production from the reservoir over time in an accurate and rapid manner, thereby enabling physically valid Field Development Plans to be rapidly computed. The preferred high speed analytical reservoir simulator is disclosed in Busswell et al. 2006, "Generalized Analytical Solution For Reservoir Problems With Multiple Wells And Boundary Conditions", SPE 99288; and Gilchrist et al. 2007, "Semi-Analytical Solution For Multiple Layer Reservoir Problems With Multiple Vertical, Horizontal, Deviated And Fractured Wells", IPTC 11718. The computational burden of a high speed analytical reservoir simulator such as a GREAT reservoir simulator is considerably less than reservoir simulators relying on finite element analysis. The computational efficiency gains using a high speed analytical reservoir simulator enable the practical realization of candidate Field Development Plans such that an optimizer can be used to evaluate an objective function for a Figure of Merit (FoM) of the candidate Field Development Plans, or run stochastic sampling loops in order to determine the effects of parameter uncertainty on the calculated Figure of Merit (FoM) for the candidate Field Development Plans.

One aspect of the invention is directed to a method of selecting an optimized Field Development Plan. The Field Development Plan has at least one platform location, as well as borehole trajectories and well completions for an oil or gas field. The method begins with a Shared Earth Model (SEM) including a static three-dimensional finite element map for the geological subsurface for the oil or gas field. Such a Shared Earth Model can be implemented in the PETREL® software package offered by Schlumberger Technology Corporation of Sugar Land, Tex. Next, a connected flow volume generator, for example as also provided in the PETREL® software package, determines a set of connected flow volumes from the three-dimensional, finite element map of the geological subsurface for the oil or gas field. Each connected flow volume corresponds to a distinct subsurface flow unit. In accordance with the invention, the set of connected flow volumes is then upscaled into a set of cuboid, analytical model elements suitable for use in a fast analytical reservoir simulator, such as the GREAT reservoir simulator. This high speed analytical reservoir simulator is referred to in the art as the GREAT reservoir simulator. The fast analytical reservoir simulator dynamically models flow within the respective cuboid elements in an accurate, rapid manner. Each cuboid element is defined by its dimensions, position and orientation within the geological subsurface, as well as physical parameter values, e.g., porosity, saturation and permeability, etc. In addition, each cuboid element is preferably selected to have zero flow boundary conditions. The process of selecting the dimensions, positions and orientation of the respective cuboid analytical model elements preferably employs an optimizer that ensures that the smallest cuboid available and closes all of the cells of the connected flow volume.

Once the upscaled set of cuboid elements is determined, the fast analytical simulator is able to forecast production from the set of cuboid elements based on candidate well completions. An objective function for a selected Figure of Merit (FoM) for candidate Field Development Plans relies on the production forecast from the fast analytical reservoir simulator. The selected Figure of Merit (FoM) may be net present value, total oil production for a given amount of time, or other desired Figure of Merit, but in accordance with the invention in all cases, the objective function defining the Figure of Merit relies on the output from the fast analytical reservoir simulator. In accordance with this aspect of the invention, the optimized Field Development Plan is selected by an optimizer that finds a maximum value of the objective function for the Figure of Merit. While a wide array of optimization algorithms may be used in accordance with the invention, a Nelder-Mead optimization algorithm is suitable. Use of a fast analytical reservoir simulator, such as the GREAT reservoir simulator, because of its computationally efficient and accurate output, enables the use of an optimization algorithm, while at the same time providing a complete comprehensive model of the entire Field Development Plan (FDP).

During the optimization process, it is preferred to penalize trajectories that are within collision tolerance. Also, if engineering properties and constraints support the concatenation of completions or the development of multilaterals, then the optimizer tends to combine neighboring completions to increase the Figure of Merit for the candidate Field Development Plan.

This and other aspects of the invention are preferably implemented in computer software stored on a computer readable medium. More specifically, in its preferred embodiment, the software takes the form of a software plug-in for the PETREL® software available from Schlumberger Technology Corporation.

In accordance with another aspect of the invention, the statistical deviation of the objective function for the Figure of Merit of the optimized Field Development Plan is tested with respect to uncertainty in physical variables in the Shared Earth Model (SEM). In this aspect, the software implements a stochastic sampling loop for a set of one or more uncertain physical variables in the Shared Earth Model. There are various stochastic sampling techniques known in the art that are suitable, e.g., a Monte Carlo analysis. Each stochastic sampling loop results in a modified realization for the Shared Earth Model (SEM). For each modified SEM realization, the steps of defining connected flow volumes and upscaling the connected flow volumes into cuboid, analytical model elements for the fast analytical reservoir simulator are implemented. Then, for each stochastic sampling loop, a Figure of Merit (FoM) value for the optimized Field Development Plan (FDP) for the modified Shared Earth Model (SEM) is calculated. Statistical analysis of these Figure of Merit (FoM) values such as mean, $\mu$, and standard deviation $\sigma$, are generated based on the Figure of Merit realization set for the stochastic sampling. For example, the optimized Field Development Plan may have used a 30% porosity value for a given connected flow volume, but the uncertainty in that data may have been +/−5%. This aspect of the invention evaluates the likely effect of such uncertainties on the computation of the Figure of Merit (FoM) for a given Field Development Plan (FDP). Again, use of a fast analytical reservoir simulator such as the GREAT reservoir simulator, reduces the computational requirements of the system, thereby enabling the practical use of the stochastic sampling loop.

In another aspect of the invention, the Field Development Plan (FDP) is optimized in the presence of uncertainty of physical variables in the Shared Earth Model (SEM) as well as accounting for risk aversion. A risk aversion factor ($\lambda$) such as 0 (representing no risk aversion), 0.5. 1, 1.5, 2 (representing high aversion to risk) are considered by the system. In accordance with this aspect of the invention, the objective function for the Figure of Merit for candidate Field Development Plans is degraded by a risk factor, such as $FoM_\lambda=\mu-\lambda\sigma$, where $\mu$ is the average Figure of Merit for a candidate Field Development Plan generated by stochastic sampling of uncertain physical variables, $\sigma$ is the standard deviation of these Figure of Merit values and $\lambda$ is a risk aversion factor. A plot of the average value of the Figure of Merit versus standard deviation of the Figure of Merit results in a plot known as the Efficient Frontier. For each risk aversion factor $\lambda$, the Figure of Merit is optimized along the Efficient Frontier in accordance with this aspect of the invention. In other words, an optimum Field Development Plan is selected in the presence of uncertainty in the Shared Earth Model, in accordance with this aspect of the invention, using an optimizer (e.g., Nelder-Mead) to test candidate FDPs to find the one with the maximum risk-based Figure of Merit (e.g., $FoM_\lambda=\mu-\lambda\sigma$). Again, as mentioned above, use of a fast analytical reservoir simulator such as the GREAT reservoir simulator reduces the computational burdens on the system and enables stochastic sampling and optimization to be accomplished on a comprehensive basis for the entire Field Development Plan.

In another aspect of the invention, sensitivity analysis is performed in order to identify physical variables that are regarded as significantly uncertain. This allows future efforts to focus on the most sensitive factors. Preferably, the sensitivity of the Figure of Merit (FoM) for a given Field Development Plan (FDP) with respect to uncertainty in physical variables is presented to the user in the form of a Pareto chart.

In another aspect of the invention, the method provides an estimate of the value of acquiring new data ($VoI_\lambda$) to reduce uncertainty of physical variables in the Shared Earth Model (SEM). This is preferably accomplished by selecting an initial Field Development Plan optimized for an initial Shared Earth Model wherein the optimized objective function for the Figure of Merit ($FoM_\lambda$) is degraded by a risk factor in the presence of uncertainty for physical variables in the Shared Earth Model (e.g. $FoM_\lambda=\mu-\lambda\sigma$). Then, the results of one or more measurements are applied to the Shared Earth Model in order to generate a new Shared Earth Model with reduced uncertainty for the physical variables. A risk degraded Figure of Merit ($FoM_{s1\lambda/m2}$) for the initial Field Development Plan is computed based on the new Shared Earth Model having reduced uncertainty. Then, a new Field Development Plan is optimized for the new Shared Earth Model, again with the optimized objective function for the Figure of Merit being degraded by a risk factor in the presence of the reduced uncertainty for the physical variables in the new Shared Earth Model (e.g. $FoM_\lambda=\mu-\lambda\sigma$). Then, the risk degraded Figure of Merit ($FoM_{s2\lambda/m2}$) for the new Field Development Plan based on the new Shared Earth Model having reduced uncertainty is computed. The value of acquiring the new data ($VoI_\lambda$) is determined by comparing the Figure of Merit ($FoM_{s1\lambda/m2}$) for the initial Field Development Plan calculated in light of the new Shared Earth Model to the Figure of Merit ($FoM_{s2\lambda/m2}$) of the new Field Development Plan determined in light of the new Shared Earth Model.

While various aspects of the invention has been described above generally with respect to a variety of processes implemented within a Field Development Planning system, the invention can also be characterized in terms of software and hardware components embodied within such a system. In this regard, the invention is directed to a system for automatically generating an optimized Field Development Plan, which system contains a Shared Earth Model providing a static, three-dimensional finite element map of the geological subsurface for an oil or gas field for which the Field Development Plan is being created. The system further includes a connected flow volume generator, and a fast analytical reservoir simulator that dynamically models flow within cuboid analytical model elements having zero flow boundary conditions. The system includes means for upscaling connected flow volume sets into a set of cuboid elements for the fast analytical reservoir simulator. The system also contains means for optimizing an objective function for a Figure of Merit for candidate Field Development Plans, wherein the objective function relies on a fast analytical reservoir simulator to forecast production from the set of cuboid elements. As mentioned, the optimizer can implement any suitable optimizing algorithm such as a Nelder-Mead algorithm. Preferably, the system includes a display and means for displaying the optimized Field Development Plan on the display, including an illustration of one or more platform locations, optimized borehole trajectories and capacities, and optimized completion types locations and flow rates.

The system also preferably includes means for stochastically sampling one or more uncertain physical variables in the Shared Earth Model. It also preferably includes means for considering various values of risk aversion as well as accounting for risk in the objective function for the Figure of Merit for the candidate Field Development Plans.

The preferred system also comprises an optimal measurement design interface. The interface software displays a set of sensitive physical variables, and is capable of accepting potential measurement plans designed by an expert to reduce uncertainty in the Figure of Merit due to uncertainty in the physical variables in the Shared Earth Model, as well as interface software for listing potential measurements in an order descending according to estimated value of the potential measurement and means for selecting an identified measurement from the ordered list.

Other features and advantages of the invention may be apparent to those skilled in the art upon reviewing the drawings and the following description thereof.

DETAILED DESCRIPTION

Figure 1:
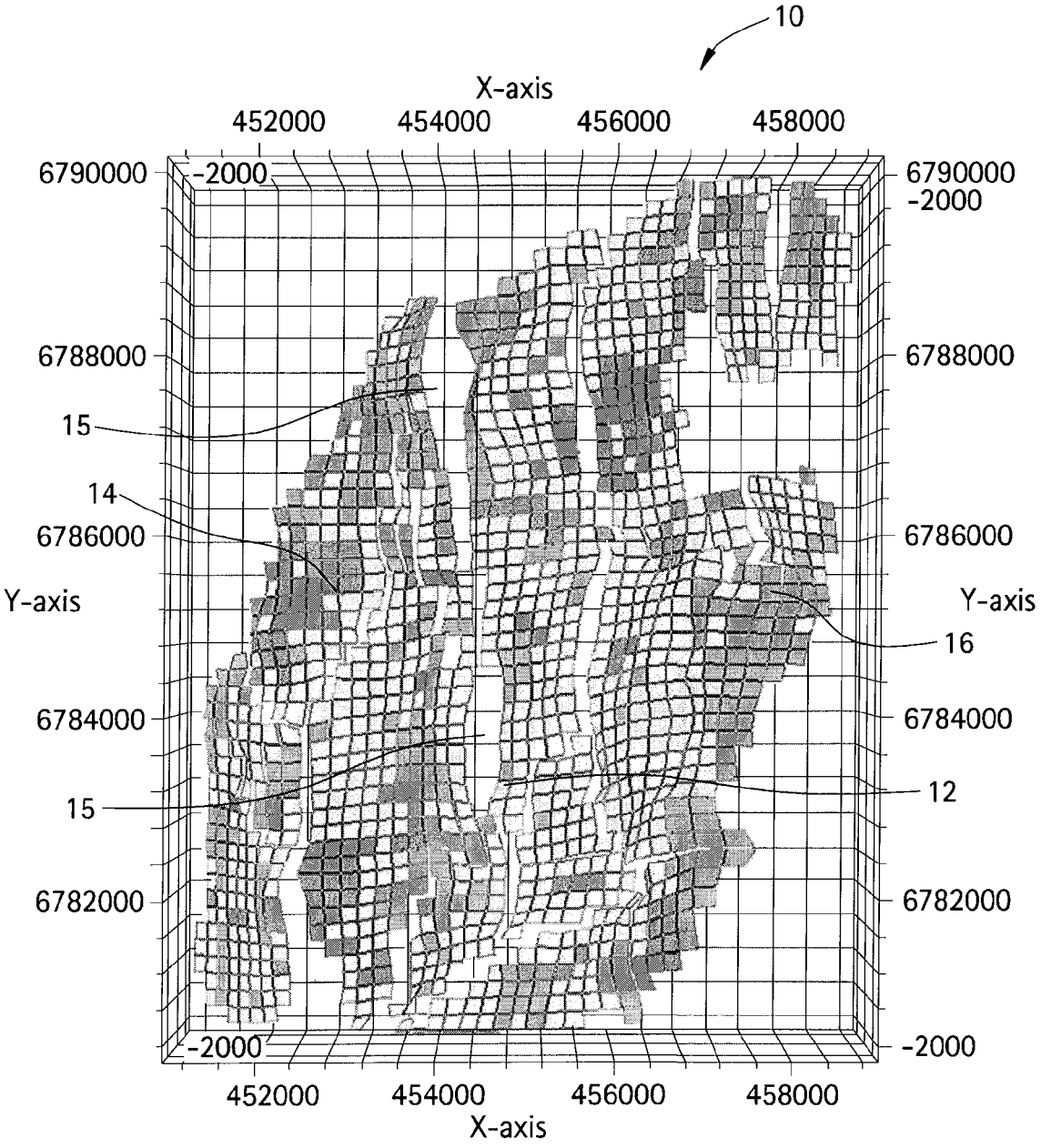
FIG. 1 is a representative reservoir map of an oil field embodied in a Shared Earth Model (SEM).

FIG. 1 illustrates a reservoir map 10 for an oil or gas field, as displayed on a computer monitor running, for example, software that provides access to information in a Shared Earth Model (SEM) and various software tools for analysis of the data in the model (e.g., PETREL® software package available from Schlumberger Technology Corporation). The degree of shading in the example reservoir map 10 shown in FIG. 1 references different facies or rock formations. More specifically, in the example reservoir map 10 reference numerals 12, 14 and 16 reference different fluvial facies whereas the open areas 15 represent other types of rock formations. The reservoir map 10 is depicted as a finite element mesh within an orthonormal (i, j, k) grid, as is known in the art, and it is generated based on parameters that exist in a Shared Earth Model. While FIG. 1 illustrates the map 10 in two dimensions, the reservoir map 10 is actually a static, three-dimensional finite element map for the geological subsurface of the oil or gas field. FIG. 1 illustrates a horizontal slice in an x-y plane 50 meters thick and approximately 2,000 meters below the surface.

Details of a Shared Earth Model suitable for use in the present invention are disclosed in Fanchi 2002, "Shared Earth Modeling: Methodologies For Integrated Reservoir Simulations", Butterworth-Heinemann, 306 pp. Preferably, the Shared Earth Model represents static and dynamic data for multiple disciplines including data describing not only the reservoir, but also the overburden.

In order to implement the invention, it is necessary to create a set of cuboid, analytical model elements, e.g. a set of GREAT model elements, from an existing Shared Earth Model 10. As described in more detail with respect to FIG. 4, this process (Process A) is implemented by creating connected volumes from the reservoir map 10 in the Shared Earth Model (SEM) and then upscaling the connected volumes into a set of cuboid elements suitable for use in the fast analytical reservoir simulator.

Figure 2:
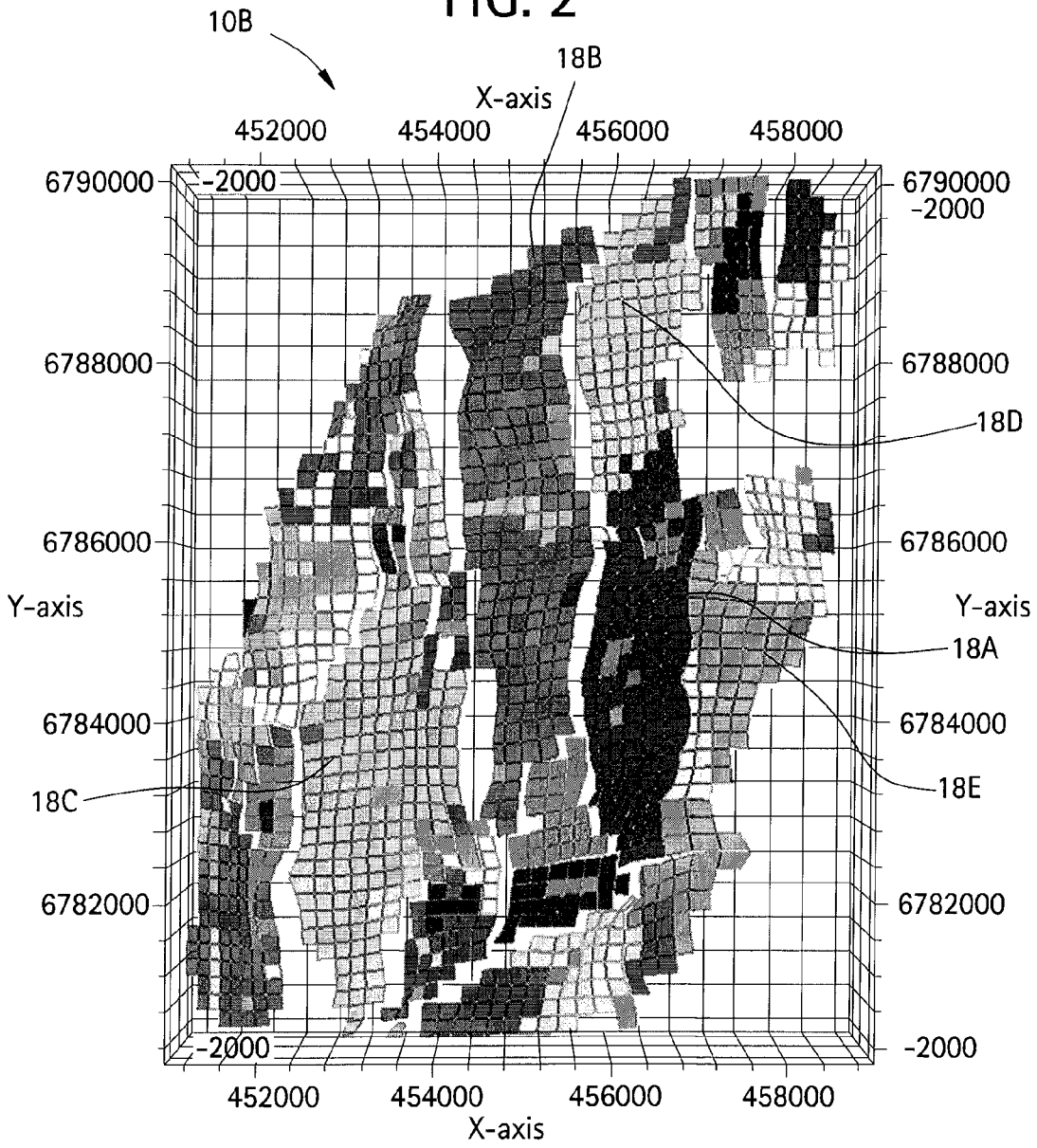
FIG. 2 is a map of the same reservoir shown in FIG. 1, shaded to show connected flow volumes.

Referring to FIG. 2, contiguous facies, or connected flow volumes are illustrated in the reservoir map 10B. The larger connected flow volumes in FIG. 2 are represented by reference numbers 18A, 18B, 18C, 18D and 18E. Connected volume generators are known in the art, and the connected volume generator associated with the PETREL® software package is suitable for generating the connected flow volume, e.g. 18A-18E. In FIG. 2, each connected flow volume set is a collection of cells from FIG. 1 in the Shared Earth Model (SEM) that have similar measured physical properties and are contiguous. In the example shown in FIGS. 1 and 2, the reservoir map 10 of facies type in FIG. 1 for a fluvial system is used as input to a connected volume analysis which results in the map 10B illustrated in FIG. 2. In accordance with the invention, each connected volume, e.g. 18A-18E, in FIG. 2 corresponds to a distinct flow unit.

Figure 3:
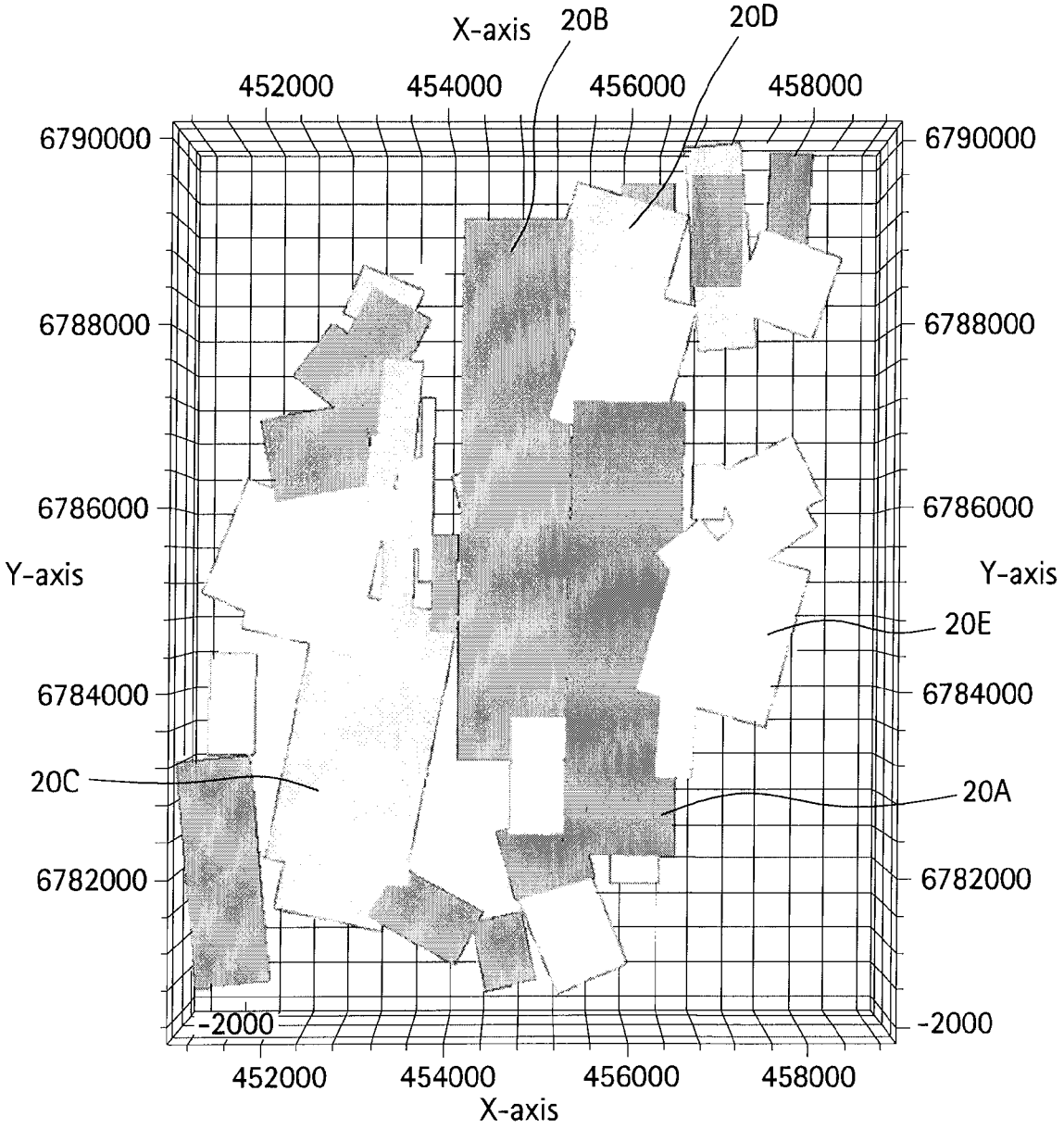
FIG. 3 is an illustration of the reservoir map illustrated in FIGS. 1 and 2 in which the connected flow volumes of FIG. 2 have been upscaled into cuboid, analytical model elements (GREAT model set). Each cuboid element corresponds to a single connected flow volume in FIG. 2.

Referring now to FIG. 3, the next step is to upscale the connected volumes, e.g., 18*a*-18*e*, shown in FIG. 2, into cuboid, analytical model elements (e.g., GREAT model elements) as depicted in FIG. 3. In this step, the size, position, orientation and physical properties of each GREAT model element are correlated to the respective properties of the associated connected flow volume 18A-18E, FIG. 2. In FIG. 3, the GREAT model elements labeled 20A, 20B, 20C, 20D and 20E correlate specifically to the connected flow volumes labeled 18A, 18B, 18C, 18D and 18E, as illustrated in FIG. 2. Of course, as can be seen from FIG. 3, there are many other GREAT model elements in FIG. 3 corresponding to the other respective connected flow elements shown in FIG. 2. The upscaling algorithm depends on the specifics of the data set, but results in GREAT model elements, e.g. 20A-20E, each with an optimized geometry (dimensions and orientation), as well as unique porosity, saturation and permeability values.

More specifically, the upscaling algorithm first determines the geometry of the GREAT model element, including the layer thickness, position and orientation within the subsurface. Material properties including porosity and azimuthal permeabilities are averaged. For a given connected volume 18A-18E, the upscaling algorithm places a bounding cuboid that encloses all the cells defining the connected volume. An optimizer ensures that this is the smallest box that encloses all of the cells of the connected volume. If a single connected flow volume, e.g., 18A-18E, has significant heterogeneity in its flow properties, e.g., porosity, permeability or saturation, then the GREAT model element may be subdivided into layers. If layering in the original data is to be preserved, then the thicknesses of the layers in the upscaled model elements are set to the relative volume of each layer in the original data. At this point, the geometries of the GREAT model elements, e.g., 20A-20E, are known. To upscale the material properties to the GREAT model elements, the pore volume must be preserved. Thus, the total pore volume in the original data is computed and divided by the volume of the corresponding layer in the GREAT model element. This becomes the effective porosity of the upscaled layer. Permeability of each layer is computed by evaluating the weighted arithmetic mean of the permeabilities in the original data. That is, the permeability in each initial cell is multiplied by the volume of the cell and the sum of these products is then divided by the total volume of the cells. This is done for each permeability axes (x, y, z) for each layer. Individual GREAT model elements are preferably rejected if they correspond to invalid facies (e.g. interchannel shales), or their petrophysical properties fall outside of predetermined constraints, such as minimum allowed permeability or valid facies types.

The preferred version of the GREAT reservoir simulator (i.e. Gilchrist et al.) supports a layered model which allows flow between adjacent layers. The justification of using a multilayered GREAT model rather than a single layer to represent a single connected flow volume is based on information theory. In other words, the information loss when a model represents data is a tradeoff between the precision and complexity of the model. The more parameters in the model, the more precisely the model will fit the data, but the increased number of parameters makes the model more complex. The goal is to identify the appropriate balance between precision and complexity. Examples of appropriate methods to evaluate information criteria (IC) include Akaike 1974, "A New Look At The Statistical Model Identification", IEEE Transactions and Automatic Control, 19(6): 716-723 and Bayesian, Burnham and Anderson 2004, "Multimodel inference: Understanding AIC and BIC in model selection", Amsterdam Workshop on Model Selection. If a single connected volume, e.g., 18A, has significant lateral heterogeneity it its flow properties, then the GREAT model element can further be subdivided into cells as appropriate. Again, an information criteria approach is used to determine whether this more complex model is justified.

Figure 4:
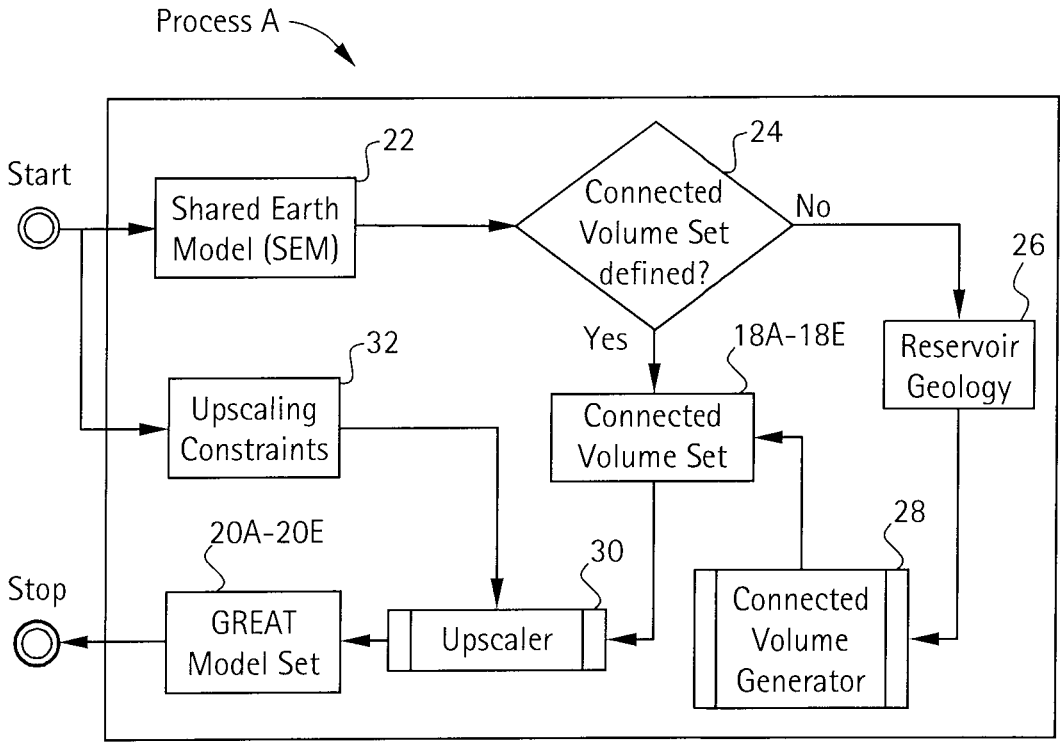
FIG. 4 is a flowchart illustrating the steps (Process A) involved in creating a GREAT model set from a Shared Earth Model in accordance with the invention.

FIG. 4 is a flowchart summarizing the steps involved in creating the set of GREAT model elements describing the geological subsurface for the oil or gas field. These steps are referred to herein as Process A. The initial step in Process A is to provide a Shared Earth Model (SEM) for the oil or gas field, reference number 22. The next step is to determine whether a connected flow volume set has been determined for the Shared Earth Model (SEM) for this oil or gas field, reference number 24. If not, the reservoir geology, such as illustrated by the finite element mesh reservoir map 10 in FIG. 1 is loaded, reference number 26. A connected volume generator 28, such as the connected volume generator module in PETREL® software, generates a connected volume set, e.g., 18A-18E. Note that it may not be necessary to generate the connected volume set each time that Process A is called when implementing the software. The connected volume set 18A-18E is then provided to an upscaler 30, which generates a set of GREAT model elements 20A-20E, as described in connection with FIG. 2. The operation of the upscaler 30 is affected by the nature of upscaling constraints, reference number 32, which are provided to the upscaler 30. The upscaling constraints 32 may include the rejection of various characteristics which are not tenable or realistic, as well as the decision to use multilayered or cubed GREAT model elements in order to simulate heterogeneity in flow properties within the connected volume. As mentioned, the output from the upscaler 30 are cuboid, analytical model elements, e.g., 20A-20E (also referred to herein as a GREAT model set), each having defined dimensions, position and orientation corresponding to the respective connected volumes 18A-18E, and each having assigned thereto approximate or average physical properties such as porosity, saturation, and permeability.

Figure 5:
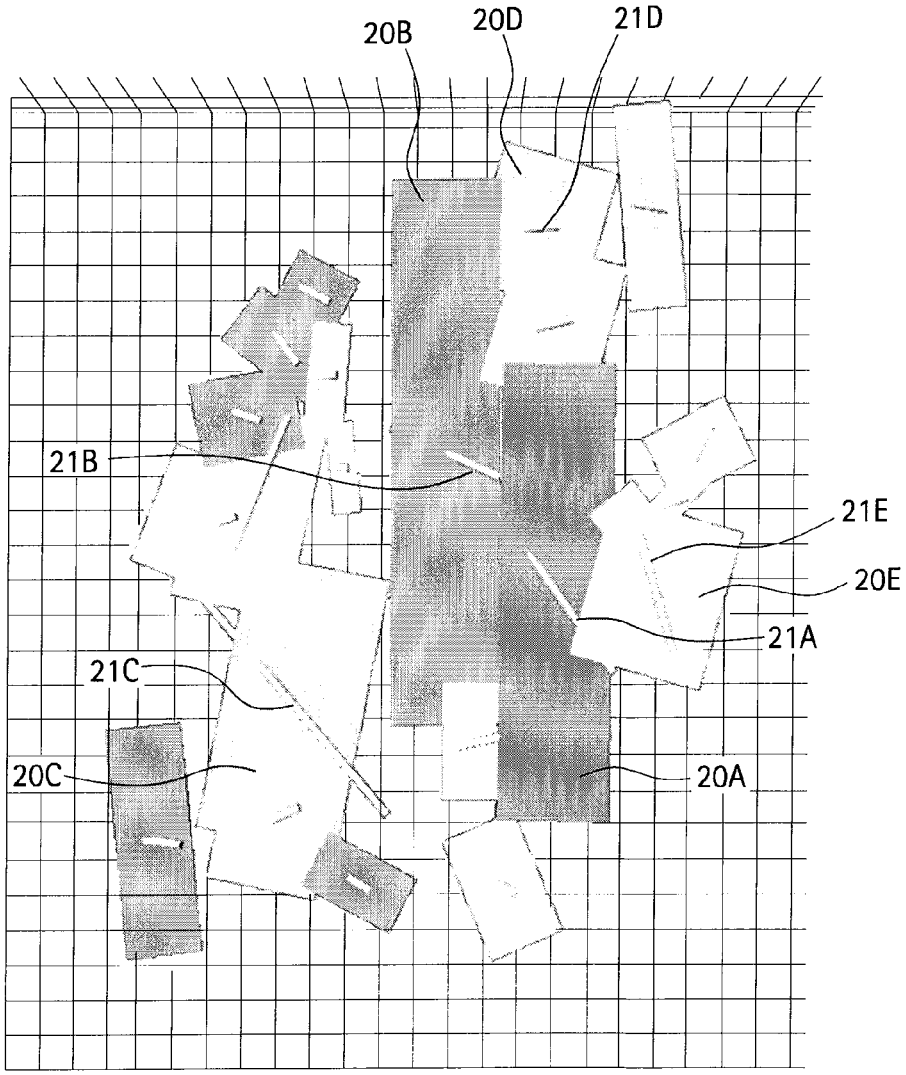
FIG. 5 illustrates the reservoir map shown in FIG. 3 with a GREAT model set and optimized well completions.

Referring to FIG. 5, once the GREAT model set 20A-20E has been generated for the oil or gas field, the next step in the process is to determine an optimized set of completions 21A, 21B, 21C, 21D, 21E for the GREAT model elements 20A-20E. Once the optimized position, orientation and capacity for the completions 21A-21E have been determined, the remaining components of the Field Development Plan 23 are optimized.

Figure 6:
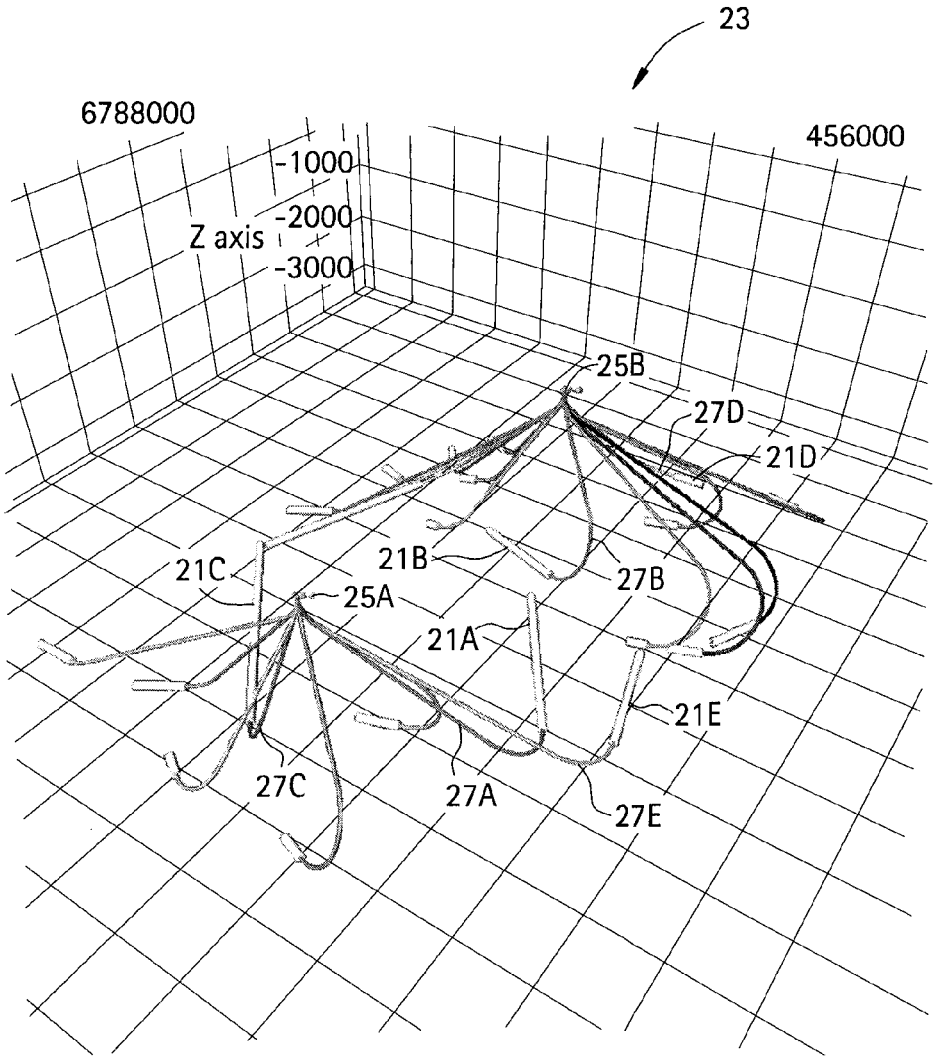
FIG. 6 is a perspective view of a Field Development Plan (FDP) having platform locations, optimized borehole trajectories, and optimized completions for the oil fields illustrated in FIGS. 1-3, and 5.
Figure 7:
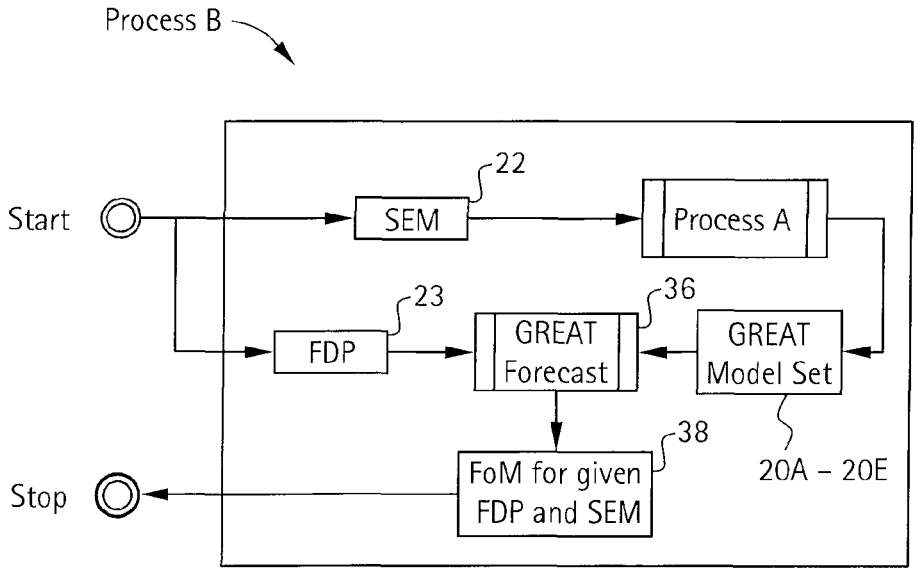
FIG. 7 is a flowchart illustrating the steps (Process B) involved with computing a Figure of Merit (FoM) for a given Field Development Plan (FDP) and Shared Earth Model (SEM) as in accordance with the invention.

A representative Field Development Plan (FDP) is shown in FIG. 6. The exemplary Field Development Plan 23 in FIG. 6 includes two drilling platforms 25A, 25B, as well as optimized well completions, for example 21A-21E, and optimized borehole trajectories, for example 27A-27E. One of the primary purposes of the invention, as mentioned, is to automatically determine an optimized Field Development Plan (FDP) 23. In order to do this, the system first computes a Figure of Merit (FoM) for a given Field Development Plan 23 for a given Shared Earth Model (SEM). The preferred steps for implementing this function are shown in FIG. 7, which is referred to herein as Process B. Then, an optimizer (44, FIG. 8) is used to select a Field Development Plan for the Shared Earth Model 22 and GREAT model set 20A-20E in which a Figure of Merit (FoM) has been maximized, in light of optimization constraints, such as physical, engineering, operational or financial constraints on the proposed project. The optimization process is identified herein as Process C and is shown generally in FIG. 8.

Referring specifically to FIG. 7, as mentioned, Process B illustrates the steps involved in computing a Figure of Merit (FoM) for a given Field Development Plan 23 and Shared Earth Model 22. The Shared Earth Model 22 is provided to Process A to generate a GREAT model set 20A-20E, as described in connection with FIG. 4. The resulting GREAT model set 20A-20E is provided to the GREAT reservoir simulator, as is the proposed Field Development Plan 23. As mentioned, the preferred fast analytical reservoir simulator is the GREAT reservoir simulator disclosed in the above described Busswell and Gilchrist references, although other fast analytical reservoir simulators may be used if suitable. Block 36 in FIG. 7, which is labeled GREAT Forecast, contains an objective function for a Figure of Merit (FoM) such as net present value or production over a given period of time, or other desired Figure of Merit, which depends on the production forecast output by the GREAT reservoir simulator for the candidate Field Development Plan 23 and the relevant GREAT model set 20A-20E garnered from the Shared Earth Model 22. The GREAT reservoir simulator 36 computes production profiles for each of the completions 21A-21E in the candidate Field Development Plan 23. A Figure of Merit is computed for each trajectory, and the overall Figure of Merit is computed for the combined set of trajectories by summation. Trajectory interference (collision risk) is reduced by penalizing trajectories that are within a collision distance. Completion interference is accounted for by considering all completions in a single GREAT model simultaneously.

Process B, illustrated in FIG. 7, depicts an objective function for the Figure of Merit for the candidate Field Development Plans which serve as a kernel for many other operations implemented by the invention. In accordance with the invention, the objective function relies on a fast analytical reservoir simulator 36 to forecast production, thereby enabling effective use of optimization algorithms and stochastic sampling to select optimized FDPs.

Figure 8:
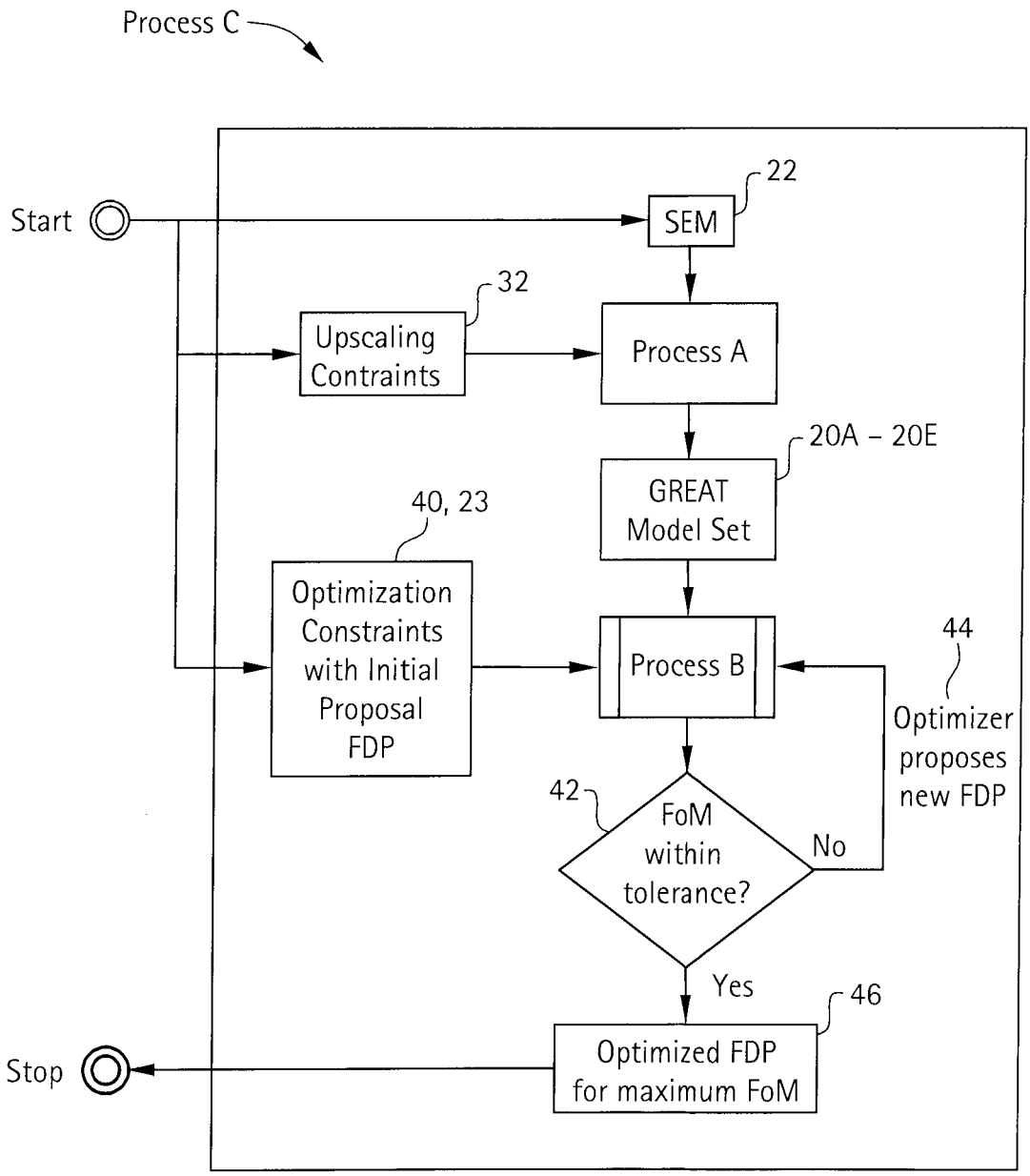
FIG. 8 is a flowchart illustrating the steps involved (Process C) with determining an optimized Field Development Plan for a given Shared Earth Model in which the objective function for the Figure of Merit is maximized.

Process C in FIG. 8 describes the steps involved in selecting an optimized Field Development Plan having a maximized Figure of Merit (i.e. maximized value for the objective function defined by Process B in FIG. 7). Referring to FIG. 8, the Shared Earth Model 22 and upscaling constraints 32 are provided to Process A as described with respect to FIG. 4 to determine a GREAT model set 20A-20E. The GREAT model set 20A-20E is provided to Process B as described with respect to FIG. 7. In addition, optimization constraints 40 and an initial proposed Field Development Plan 23 are provided. Process B, as in FIG. 7, outputs a Figure of Merit value for a given Field Development Plan and Shared Earth Model 38 based on an objective function defining net present value for the Field Development Plan, recovery factor, payback period, total oil production in a given period, percentile to get of net, utility functions, or any other objective function which may be important to evaluate when designing a Field Development Plan 23. This balance drilling, construction and production costs over time against production revenue. Also preferably incorporated into the objective function is the entire Field Development Plan in light of all safety, legal and contractual constraints. In other words, the objective is to optimize the Field Development Plan so that it provides the maximum Figure of Merit (FoM) in light of the optimization constraints. To do this, Process C in FIG. 8 implements an optimizer, such as a Nelder-Mead algorithm, to optimize the Figure of Merit (FoM) for candidate Field Development Plans (FDP). The output from Process B in FIG. 8 provides a Figure of Merit (FoM) value that is evaluated, see reference number 42, to determine whether the convergence criteria for the optimization algorithm has been met. If the convergence criteria for the optimization algorithm has not been met, see reference number 44, the optimizer proposes a new Field Development Plan. The new FDP is chosen in light of the optimization constraints 40. Process B calculates a Figure of Merit (FoM) for the new FDP in light of the GREAT model set 20A-20E. Again, the Figure of Merit (FoM) is tested for convergence criteria, see box 42, and another proposed Field Development Plan (FDP) is created if the optimization algorithm has not yet converged. This process is repeated until the convergence criteria for the optimization algorithm has been met, at which time Process C outputs an optimized Field Development Plan having a maximum Figure of Merit 46. While the Nelder-Mead optimization algorithm is suitable for use, other optimization algorithms may be used in accordance with the invention. In the preferred embodiment, when proposing new Field Development Plans, if the engineering properties and constraints support the concatenation of completions or the development of multilaterals, then the optimizer tends to combine neighboring completions to increase the Figure of Merit (FoM) for the Field Development Plan (FDP).

Figure 9:
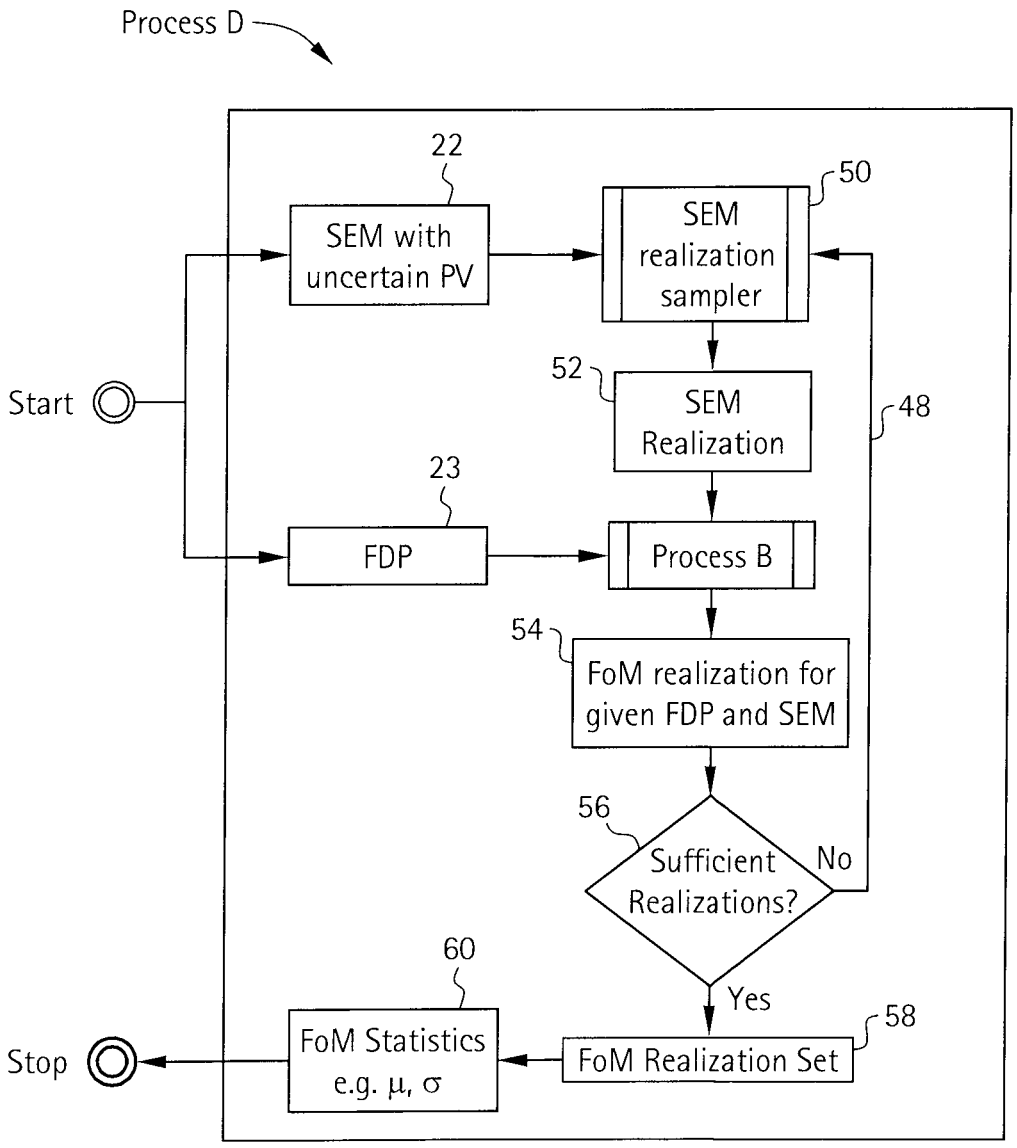
FIG. 9 is a flowchart illustrating the steps involved (Process D) with the computation of Figure of Merit (FoM) statistics for a given Field Development Plan (FDP) in the presence of uncertain physical variables in the SEM.

Turning to another feature of the invention, FIG. 9 shows the steps involved with computing statistical variations of a Figure of Merit (FoM) for a given Field Development Plan (FDP)accounting for uncertainty in physical variables in the Shared Earth Model (SEM). This process is referred to herein as Process D. Generally speaking, this function is accomplished by injecting uncertainty into physical variables in the Shared Earth Model (SEM) via a stochastic sampling loop 48, and then propagating the uncertainty through to the underlying objective function for the Figure of Merit (FoM), thereby resulting in a distribution of Figure of Merit (FoM) values from the objective function. More specifically, referring in particular to FIG. 9, a Shared Earth Model (SEM) 22 with uncertain physical variables and a Field Development Plan (FDP) 23 are initially provided. The Shared Earth Model 22 is provided to a SEM realization sampler 50, which does not modify the Shared Earth Model in the initial loop. The SEM realization sampler 50 provides a Shared Earth Model realization, reference number 52, which in the initial loop is the same as that initially provided, i.e. reference number 22. The Field Development Plan 23 and the SEM realization 52 are provided as input to Process B, FIG. 7, which involves a determination of a GREAT model set 20A-20E, as well as an evaluation of an objective function for the Figure of Merit (FoM) for the Field Development Plan 23, see reference number 54. It is important to remember that the objective function for the Figure of Merit (FoM) relies at least in part on the GREAT reservoir simulator to forecast oil or gas production over time.

Still referring to FIG. 9, a stochastic sampling algorithm, for example Monte Carlo, determines whether there have been a sufficient number of realizations for the Shared Earth Model, see reference number 56. If not, the system stochastically samples variations of one or more physical variables, reference number 48, and incorporates these variations into a new Shared Earth Model realization, blocks 50 and 52. For each stochastic sampling loop 48, the objective function for the Figure of Merit (FoM) is determined for the given Field Development Plan (FDP) and the Shared Earth Model (SEM) realization. Once the stochastic sampling algorithm has converged and a sufficient number of (SEM) realizations 52 have been processed, reference number 56, Process D outputs a Figure of Merit realization set, reference number 58, which may include, for example, about 1,000 values of the FoM (e.g., NPV) for a given Field Development Plan. The system then calculates Figure of Merit statistics such as mean, $\mu$, and standard deviation, $\sigma$ see block 60, based on the Figure of Merit realization set 58. The basic framework described in Process D of FIG. 9 thus provides a manner of defining the uncertainty of the objective function for the Figure of Merit for a given Field Development Plan in light of a given SEM. By way of example, the key input in the aforementioned examples is the fluvial facies model. The fluvial facies model is typically generated using geostatistical modeling techniques, which include parameters such as mean channel width, etc. If the uncertainty in the mean channel width is considered in the optimization, then different stochastic realizations of the mean channel width will reveal different fluvial facies distribution (and, for example, different volumetrics for the GREAT model set). While the Field Development Plan is selected based on an optimization relying on a mean geological model, it is likely sensitive to uncertainty in the data for the mean channel width. The results from Process D, i.e. the distribution of the underlying objective function for the Figure of Merit values, represents the sensitivity of the Field Development Plan to uncertainty in the mean channel width. Of course, the sensitivity analysis for a given Field Development Plan can be implemented for other uncertain variables or parameters, as well.

Figure 10:
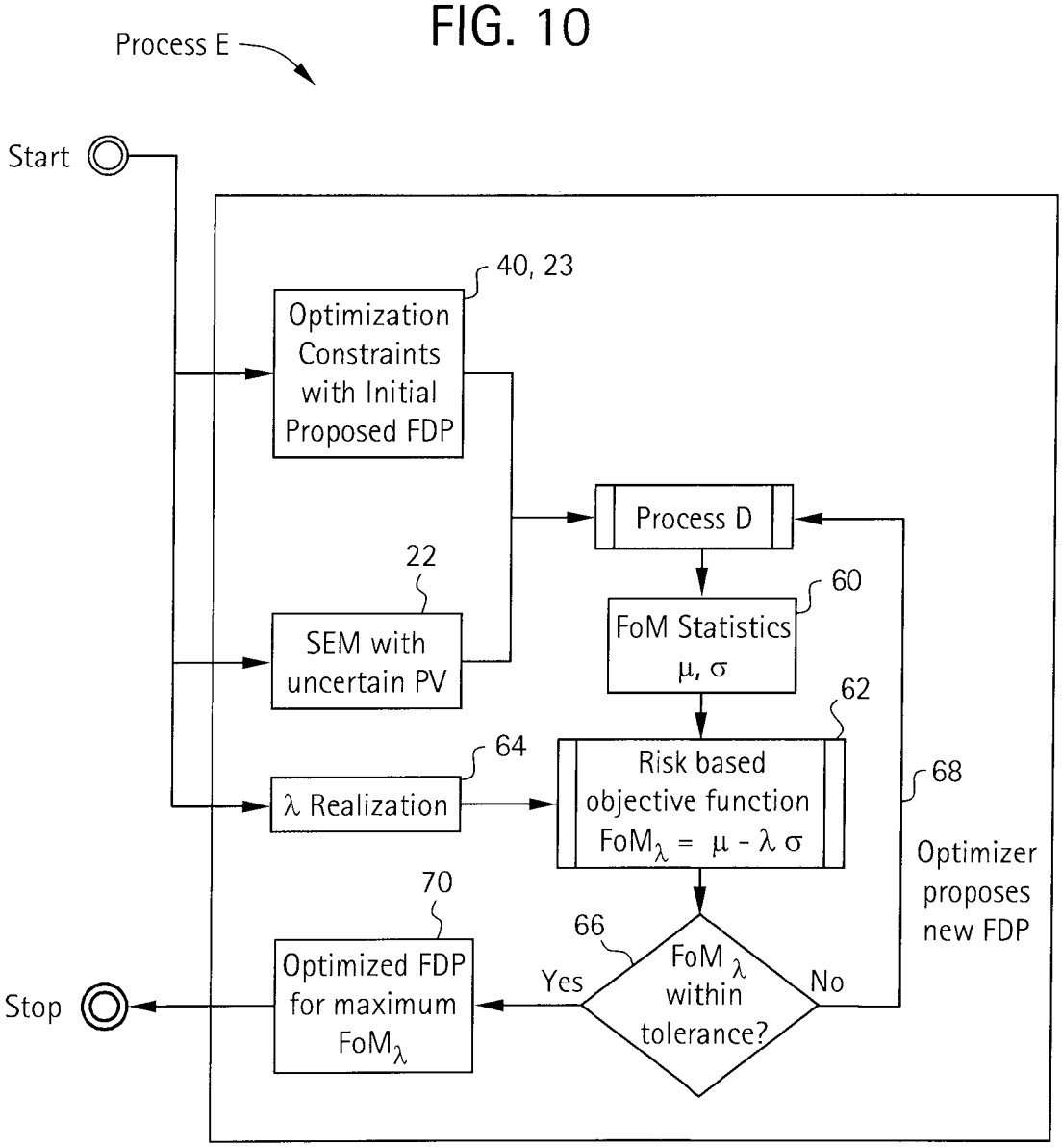
FIG. 10 is a flowchart illustrating the steps involved (Process E) with computing an optimal Field Development Plan (FDP) for a specific risk threshold (λ) in the presence of uncertainty in the physical variables in an SEM.

FIG. 10 describes another aspect of the invention in which the objective function for the Figure of Merit ($FoM_\lambda$) of candidate Field Development Plans, is degraded by a risk factor for purposes of optimization. This process is referred to herein as Process E, and it is used to generate an optimized Field Development Plan having a maximum Figure of Merit ($FoM_\lambda$) computed, in the presence of uncertainty of physical variables in the Shared Earth Model, for a given risk aversion factor ($\lambda$). In the presence of uncertain physical variables, it may not be desirable to optimize the Field Development Plan as in Process C in FIG. 8 without considering risk ($\lambda$). As described in U.S. Pat. No. 6,775,578, to Couet et al., issued on Aug. 10, 2004 and entitled "Optimization of Oil Well Production With Deference to Reservoir and Financial Uncertainty", optimization in the presence of uncertainty should consider aversion to risk. A principle difference between Process C in FIG. 8, which determines an optimized Field Development Plan while ignoring uncertainty and specific risk, and Process E in FIG. 10, which accounts for uncertainty in the Shared Earth Model and specific risk, is that the objective function for the Figure of Merit being optimized by the optimizing algorithm, e.g. Nelder-Mead algorithm, is a risk-based objective function, e.g. $FoM_\lambda=\mu-\lambda\sigma$.

Referring specifically to FIG. 10, an initial proposed Field Development Plan 23 and the optimization constraints 40, as well as an initial Shared Earth Model 22 with uncertain physical variables, are provided to Process D described in FIG. 9. As described in connection with FIG. 9, Process D includes a stochastic sampling loop 48, FIG. 9, which results in a Figure of Merit realization set 58 for the given Field Development Plan 23. Block 60 in FIG. 10 represents the FoM statistics for a given Field Development Plan 23 as determined via Process D. Block 62 in FIG. 10 represents the risk-based objective function, which in the given example, is $FoM_\lambda=\mu-\lambda\sigma$, where $\mu$ is the average Figure of Merit value for the candidate Field Development Plan generated by the stochastic sampling loop to account for physical variable uncertainty in the Shared Earth Model, $\sigma$ is the standard deviation of these Figure of Merit values and $\lambda$ is a risk aversion factor. Block 64 in FIG. 10 indicates that the risk aversion factor $\lambda$ may vary. Typically, $\lambda$ values would be 0 (no risk aversion), 0.5, 1, 1.5. 2 (significant risk aversion). Reference number 66 in Process E of FIG. 10 indicates that for each candidate Field Development Plan, the optimization algorithm, e.g. Nelder-Mead algorithm, determines whether the risk-based Figure of Merit $FoM_\lambda$ has converged to a maximum value. If the optimization algorithm has not converged, the optimizer proposes a new candidate Field Development Plan considering of course optimization constraints 40, see reference number 68. Process D is implemented on each respective candidate FDP, and the steps described above (including the steps in FIG. 9) are repeated to determine Figure of Merit statistics 60 for each candidate Field Development Plan in the presence of uncertainty in physical variables within the Shared Earth Model 22. As described above, the risk-based objective function, reference number 62, is evaluated for each candidate FDP. This process continues until the optimization algorithm determines that the risk-based objective function $FoM_\lambda$ has been maximized, at which time Process E outputs an optimized Field Development Plan corresponding to the maximum risk-based Figure of Merit $FoM_\lambda$, see reference number 70.

Figure 11:
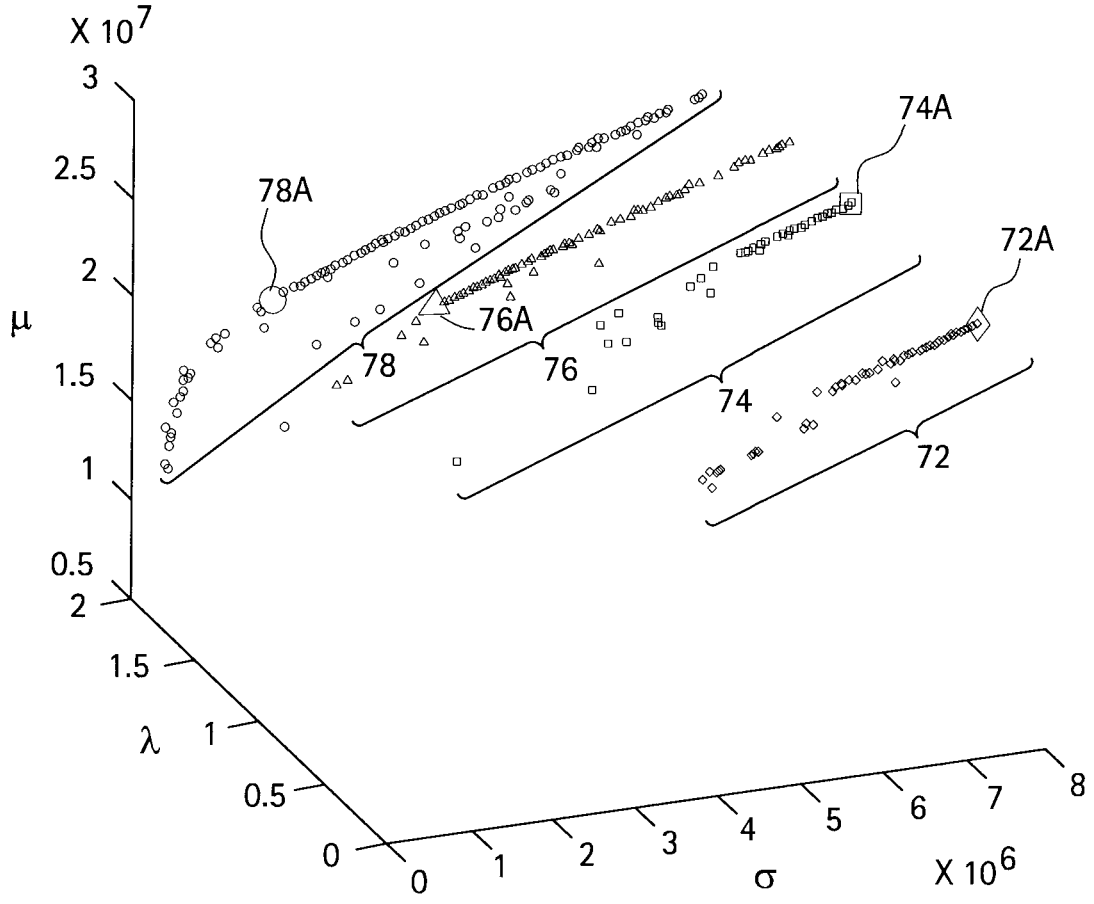
FIG. 11 is a plot illustrating the Efficient Frontier.

FIG. 11 is a three-dimensional plot illustrating an Efficient Frontier constructed from four separate implementations of Process E each having a different value of λ. The risk aversion factor λ is plotted along the y axis. The x axis represents standard deviation, σ, of the Figure of Merit (e.g., NPV). The z axis represents the mean, μ, of the Figure of Merit. Data set 72 in FIG. 11 is statistics μ, σ for the Figure of Merit realization set for λ=0. The diamond 72*a* corresponds to the Figure of Merit value of the selected optimum Field Development Plan for λ=0, i.e. the Field Development Plan having the maximum $FoM_\lambda=\mu-\lambda\sigma$. Of course, if λ is equal to 0 as with data set 72, the optimum Field Development Plan is simply the Field Development Plan which produces the highest average value, μ, in the presence of uncertain physical variables in the Shared Earth Model 22. Data set 74 shows statistics μ, σ for the Figure of Merit values for λ=1 and square 74*a* corresponds to the optimized Field Development Plan accounting for risk (λ=1) and uncertainty. Note that for λ=1, the optimum data point 74*a* is again at or near the highest average value, μ.

Data set 76 corresponds to the Figure of Merit statistics μ, σ for each candidate Field Development Plan in which λ is 1.5. Triangle 76*a* corresponds to the optimized Field Development Plan considering uncertainty and a risk aversion factor λ=1.5. Data set 78 corresponds to the Figure of Merit statistics μ, σ for each candidate Field Development Plan when the risk aversion factor λ is equal to 0. Data point 78*a* indicates the statistics μ, σ for the optimized Field Development Plan considering uncertainty and a specific risk aversion λ=2. Note that the average value, μ, for a given Field Development Plan in the presence of a Shared Earth Model with uncertain physical variables cannot lie above what is termed the Efficient Frontier. Each of the data sets 72, 74, 76, 78 if mapped on a single two-dimensional plot (x axis=σ; y axis=μ), would contain points either lying on the Efficient Frontier or underneath. The region above the Efficient Frontier is unattainable.

While the example embodiment illustrates use of a risk-based objective function being defined as $FoM_\lambda=\mu-\lambda\sigma$, other risk-based objective functions may be used in accordance with this aspect of the invention as desired or found useful.

In another aspect of the invention, a sensitivity analysis is used to identify physical variables with associated uncertainty levels that have the greatest impact on the Figure of Merit for candidate Field Development Plans. The sensitivity analysis in this regard is preferably accomplished in the following manner:

1) For an optimized Field Development Plan, execute Process B, FIG. 7, on the baseline Shared Earth Model to determine a Figure of Merit without considering uncertainty in the physical variables;
2) Considering uncertainties in the physical variables, apply an experimental design heuristic, e.g., two-level factorial design (e.g. Box and others 2005, "Statistics for Experimenters: Design, Innovation, and Discovery", Second Edition, Wiley, page 627) to define a set of SEM realizations for sensitivity analysis.
3) For each of the SEM realizations in the previously generated set, execute Process B in FIG. 7 to compute the Figure of Merit for the optimized Field Development Plan applied to the current SEM realization.
4) Collect computed FoM values in a set until all samples in the experimental design sets have been processed.
5) For each physical variable, compute the sensitivity of the Figure of Merit to that variable and present the results to the user, for example in the form of a Pareto chart, so that sensitive and insensitive physical variables can be identified.

Figure 13:
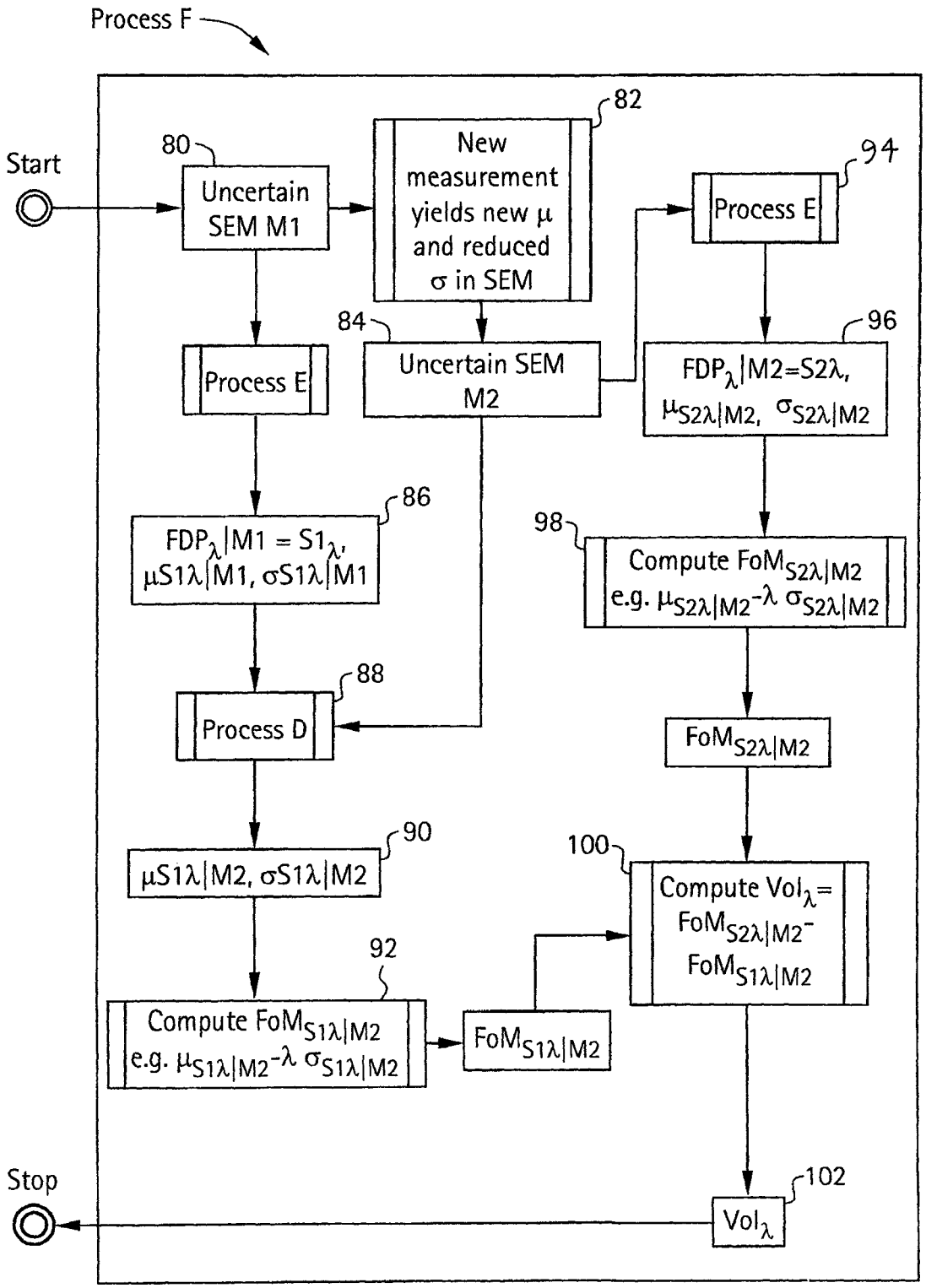
FIG. 13 is a flowchart illustrating the steps involved with determining the value of acquiring additional information for a Shared Earth Model in accordance with the invention.

Acquiring new information or data about a reservoir by taking measurements to reduce the uncertainty in one or more physical variables will always have a cost. To justify this cost, it is important to know the value of the new information (VoI). FIG. 13 describes the steps involved in the preferred embodiment of the invention for determining the value of obtaining such new information. This process is referred to herein as Process F. Referring to FIG. 13, the preferred process for determining the value of new information (VoI) begins with an uncertain Shared Earth Model M1, reference number 80. As indicated by reference number 82, a measurement is to be applied to the initial uncertain Shared Earth Model M1. The measurement 82 is expected to reduce the uncertainty in one or more physical variables for M1, thereby resulting in a new, more accurate Shared Earth Model M2, block 84. The new model M2 has less uncertainty than the initial "incorrect" model M1.

A risk-based Figure of Merit analysis (see Process E in FIG. 10) is applied to M1 to generate an optimal Field Development Plan ($FDP_\lambda$/M1) for each λ (see block 86). Note that this is the optimal risk-based Field Development Plan applied to the incorrect SEM M1. Next, the FoM statistics, e.g. μ, σ, in the presence of SEM uncertainty are calculated for $FDP_\lambda$/M1 (optimized in light of the incorrect SEM M1) but using the more accurate SEM M2, see block 88, 90 and 92, instead of SEM M1. A risk-based Figure of Merit is computed ($FoM_{S1\lambda/M2}=\mu_{S1\lambda/M2}-\lambda\sigma_{S1\lambda/M2}$) from these statistics.

Next, an optimum Field Development Plan $FDP_\lambda$/M2 in the presence of uncertainty and risk (λ) is determined for the more accurate Shared Earth Model M2, see reference numbers 94, 96. Note that this Field Development ($FDP_\lambda$/M2) Plan has been optimized for the new, more accurate Shared Earth Model M2. A risk-based Figure of Merit ($FoM_{S2\lambda}$/M2) is calculated for the Field Development Plan ($FDP_\lambda$/M2) optimized for the more correct Shared Earth Model M2, see reference number 98 ($FoM_{S2\lambda/M2}=\mu_{S2\lambda/M2}-\lambda\sigma_{S2\lambda/M2}$). The respective Figure of Merit values are compared, reference number 100, to determine the value of information (VoI) for a given λ, reference number 102 ($FoM_{S2\lambda/M2}-(FoM_{S1\lambda/M2})$. Note that this approach to analyzing the value of information ($VoI_\lambda$) applies only after the measurement has been acquired.

Figure 12:
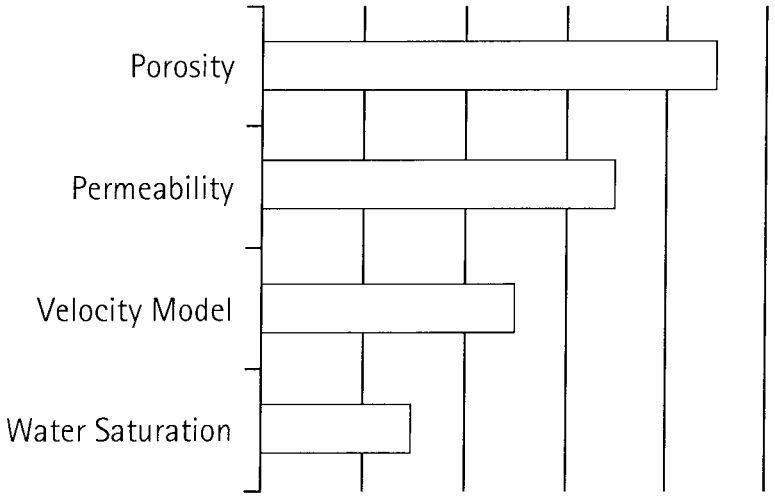
FIG. 12 is an example chart illustrating the sensitivity of the computed Figure of Merit for a given Field Development Plan with respect to various uncertain physical variables.
Figure 14:
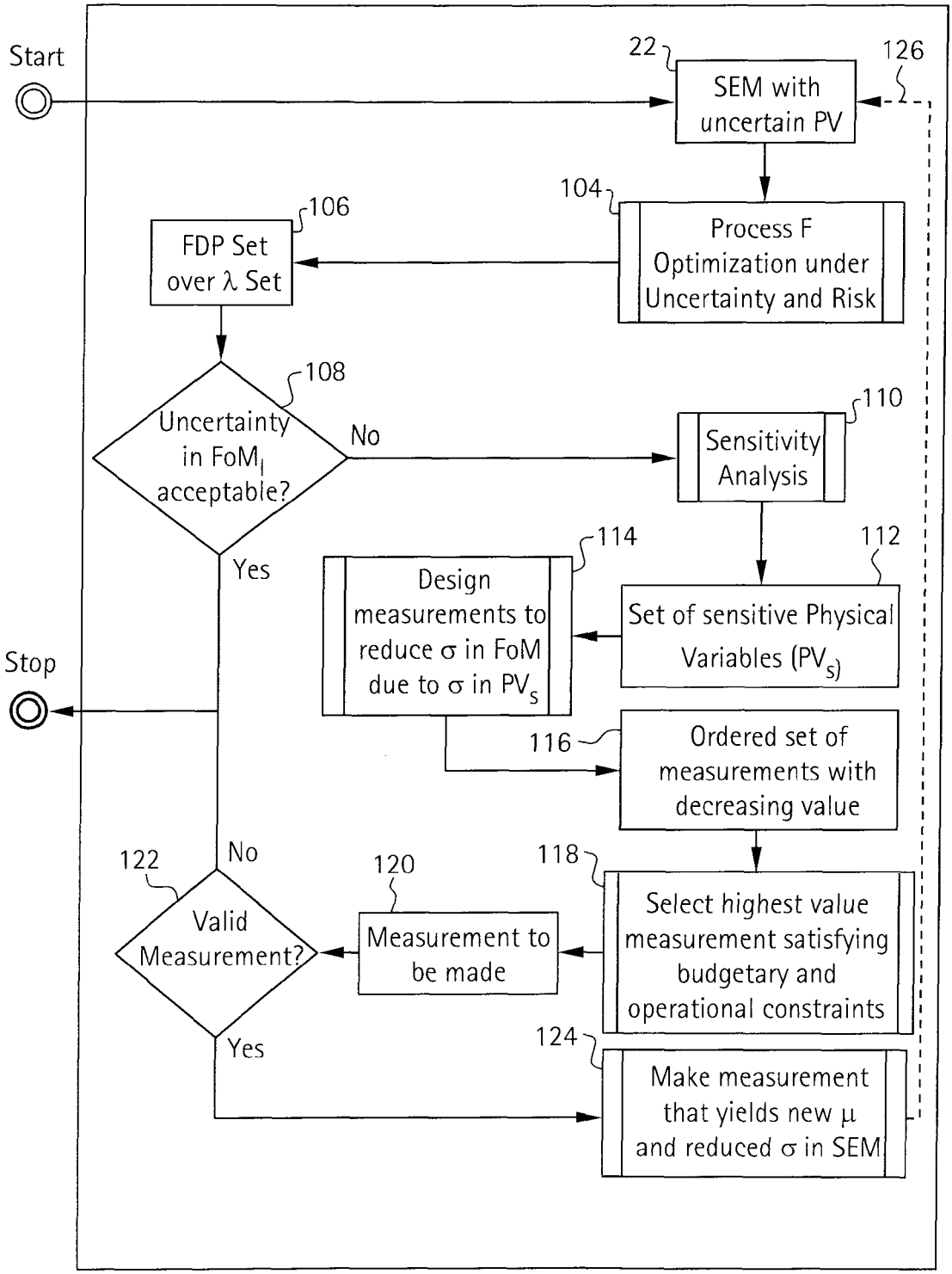
FIG. 14 is a flowchart illustrating the steps involved with the use of an optimal measurement design interface as in accordance with one embodiment of the invention.

FIG. 14 is a flowchart relating to the workflow for a system software interface which facilitates optimal design of additional physical measurements for a SEM. A set of optimized Field Development Plans for each risk factor (λ) is produced, reference numbers 104, 106, as described above. The system decides, for each λ, whether the amount of uncertainty in the respective Figure of Merit is acceptable, 108. If so, the system prompts the user that no additional measurements need be designed. If not, the system conducts a sensitivity analysis as described above, block 110, and outputs a set of sensitive physical variables, block 112, see for example the chart of FIG. 12. The computer system then prompts the user to input potential measurement plans intended to reduce the uncertainty in the Figure of Merit due to the uncertainty of one or more of the sensitive physical variables, see block 114. The system automatically lists the potential measurement plans, preferably in descending order with respect to the estimated value of the potential measurement, see block 116. Alternatively, the system prompts the user to enter the measurements in value order, or change the order based on the user's experience. In the preferred system, the preliminary set of measurements are listed so that measurements with the greatest expected value are performed before those of lesser value. The range distribution of values for each measurement is assumed. Then, the system allows the most probable (i.e. expected) value (and uncertainty therein) of the measurement to be estimated by the domain specialist or obtained using a technique similar to that described earlier. Note that the measurement value should consider the measurement cost.

Next, the user selects the first measurement in the ordered list, reference number 116, which is tested, reference number 118, to determine whether it meets budgetary and operational constraints. A measurement is not performed if it causes the cumulative measurement cost to exceed an allocated budget or other operational criteria such as equipment availability, timing, etc. The system tests the listed measurements 116 in order until it finds a measurement satisfying the budgetary or operational constraints. If a valid measurement can be made, reference number 120, the system prompts the user to make the measurement, reference number 124. Otherwise the system is exited, see reference number 122. Once the measurement is made, the information is entered into the Shared Earth Model as indicated by dashed line 126. The process in FIG. 14 can be repeated as desired.

We claim:

1. A method of selecting an optimized Field Development Plan with at least one platform location, borehole trajectories and well completions for an oil or gas field, comprising:

a) providing a Shared Earth Model including a static three-dimensional, finite element map for a geological subsurface of an oil or gas field;

b) determining a set of connected flow volumes from the three-dimensional, finite element map of the geological subsurface for the oil or gas field, each connected flow volume corresponding to a distinct subsurface flow unit;

c) upscaling the set of connected flow volumes into a set of cuboid, analytical model elements suitable for use in a fast analytical reservoir simulator that dynamically models flow within respective cuboid elements, wherein each cuboid element is defined by its dimensions, position and orientation within the geological subsurface as well as physical parameter values for the cuboid;

d) selecting an optimized Field Development Plan having one or more platform locations, borehole trajectories and well completions for the set of cuboid elements describing the geological subsurface of the oil or gas field, wherein the optimized Field Development Plan is selected based on optimization of an objective function for a Figure of Merit for candidate Field Development Plans, the objective function comprising use of the fast analytical reservoir simulator to forecast production from the set of cuboid, analytical model elements; and wherein each cuboid analytical model element is assigned parameter values for porosity, permeability and saturation; and wherein one or more of the cuboid analytical model elements are subdivided into vertical or horizontal layers such that modeled flow is allowed between the subdivided layers if at least one of the parameter values is heterogeneous.

2. A method of selecting an optimized Field Development Plan as recited in claim 1 wherein the cuboid, analytical model elements are selected to have zero flow boundary conditions.

3. A method of selecting an optimized Field Development Plan as recited in claim 1 wherein the Figure of Merit is selected from the group consisting of: net present value, recovery factor, payback period, total oil production for a given period, percentile to get of net, and utility functions.

4. A method of selecting an optimized Field Development Plan as recited in claim 1 wherein the optimization of the objective function for the Figure of Merit is accomplished using a Nelder-Mead optimization algorithm.

5. A method of selecting an optimized Field Development Plan as recited in claim 1 wherein optimization of the objective function for the Figure of Merit to determine the optimum Field Development Plan penalizes trajectories that are within collision tolerance.

6. A method of selecting an optimized Field Development Plan as recited in claim 1 further comprising the step of combining two or more of the well completions during the optimization step where doing so would increase the Figure of Merit.

7. A method of selecting an optimized Field Development Plan as recited in claim 1 further comprising:

providing a stochastic sampling loop for a set of one or more uncertain physical variables in the Shared Earth Model, thereby realizing a new SEM realization for each stochastic sampling loop;

implementing steps b) and c) for each stochastic sampling loop and then for each stochastic sampling loop, calculating a Figure of Merit value for the FDP in light of upscaled cuboid elements for the respective SEM realization; and providing statistical analysis of the Figure of Merit values for the Field Development Plan generated by stochastic sampling.

8. A method of selecting an optimized Field Development Plan as recited in claim 7 wherein the statistical analysis comprises at least a determination of a mean value, $\mu$ for the Figure of Merit values generated by stochastic sampling and the standard deviation, $\sigma$ of the Figure of Merit values generated by stochastic sampling.

9. A method of selecting an optimized Field Development Plan as recited in claim 7 wherein the objective function for the Figure of Merit for the candidate Field Development Plans is degraded by a risk factor.

10. A method of selecting an optimized Field Development Plan as recited in claim 9 wherein the objective function that is optimized is:

$$FoM\lambda=\mu-\sigma\lambda$$

where $\mu$, is the average of the Figure of Merit values generated by stochastic sampling for the candidate Field Development Plans, $\sigma$ is the standard deviation of the Figure of Merit values generated by stochastic sampling for the candidate Field Development Plans, and $\lambda$ is a risk aversion factor.

11. A method of selecting an optimized Field Development Plan as recited in claim 9 further comprising the step of estimating a value of acquiring new data to reduce uncertainty of physical variables in the Shared Earth Model.

12. A method of selecting an optimized Field Development Plan as recited in claim 7 comprising the step of determining a sensitivity of the calculated Figure of Merit for the optimized Field Development Plan with respect to one or more uncertain physical variables in the Shared Earth Model.

13. A method of selecting an optimized Field Development Plan as recited in claim 12 wherein the step of determining sensitivity of the Figure of Merit of the optimized Field Development Plan with respect to one or more uncertain physical variables in the Shared Earth Model is accomplished by:

using expected uncertainty values for one or more physical variables in the Shared Earth Model to define an experimental design sample set of uncertainty-based Shared Earth Models;

for the optimized Field Development Plan and each uncertainty-based Shared Earth Model, execute steps b) and c), computed a Figure of Merit for the optimized Field Development Plan, and collect the computed Figure of Merit value in a set until all samples in the experimental design sample set have been processed;

compute the sensitivity of the Figure of Merit for the Field Development Plan with respect to each physical variable; and present the results to a user.

14. A method of selecting an optimized Field Development Plan as recited in claim 13 wherein the sensitivity of the Figure of Merit for the Field Development Plan with respect to uncertainty and physical variables is presented to the user in the form of a Pareto chart.

15. A method of determining a value for a result of one or more measurements in a Shared Earth Model comprising:

selecting an initial Field Development Plan optimized for an initial Shared Earth Model wherein an objective function for a Figure of Merit is degraded by a risk factor in the presence of uncertainty for physical variables in the Shared Earth Model;

applying the results of one or more measurements to the Shared Earth Model in order to generate a new Shared Earth Model with reduced uncertainty for physical variables;

computing a risk degraded Figure of Merit (FoMs1λ/m2) for the initial Field Development Plan based on the new Shared Earth Model having reduced uncertainty;

selecting a new Field Development Plan optimized for the new Shared Earth Model wherein the objective function for the Figure of Merit is degraded by the risk factor in the presence of the reduced uncertainty for the physical variables in the new Shared Earth Model;

computing a risk degraded Figure of Merit (FoMs2 λ/m2) for the new Field Development Plan based on the new Shared Earth Model having reduced uncertainty; and comparing (FoMs1 λ/m2) to (FoMs2λ/m2) to determine the value of acquiring new data.

16. A computer system for automatically generating an optimized Field Development Plan, when computer software stored on a computer readable storage medium is executed by a computer, the system comprising:

a Shared Earth Model providing a static, three-dimensional, finite element map for the geological subsurface of an oil or gas field;

a connected flow volume generator that determines a set of connected flow volumes from the static, three-dimensional, finite element map of the Shared Earth Model;

a fast analytical reservoir simulator that dynamically models flow within cuboid, analytical model elements having zero flow boundary conditions;

means for upscaling the set of connected flow volumes into a set of cuboid elements for the fast analytical reservoir simulator;

means for optimizing an objective function for a Figure of Merit for candidate Field Development Plans, the objective function comprising use of the fast analytical reservoir simulator to forecast production from the set of cuboid elements;

wherein the system is a computer system and each of the Shared Earth Model, connected flow volume generator, fast analytical reservoir simulator, and means for optimizing consist of computer software stored on a computer readable medium;

means for determining the sensitivity of a Figure of Merit of an optimized Field Development Plan with respect to one or more uncertain physical variables in the Shared Earth Model;

means for displaying a set of sensitive physical variables;

means for inputting potential design measurements to reduce uncertainty in a Figure of Merit due to uncertainty in physical variables in the Shared Earth Model;

means for listing potential design measurements in an order ascending or descending with respect to an estimated value of the potential measurement plan; and means for selecting a measurement from the ordered list and for determining whether selected measurements satisfy budgetary and operational constraints.

17. A system for automatically generating a Field Development Plan as recited in claim 16 wherein said means for optimizing the objective function for the Figure of Merit of candidate Field Development Plans comprises a Nelder-Mead algorithm.

18. A system for automatically generating a Field Development Plan as recited in claim 16 wherein the system further comprises a display and means for displaying the optimized Field Development Plan comprising one or more platform locations, optimized borehole trajectories and capacities, and optimized completion types, locations and flow rates.

19. A system for automatically generating a Field Development Plan as recited in claim 16 further comprising means for stochastically sampling a set of one or more uncertain physical variables in the Shared Earth Model.

20. A system for automatically generating a Field Development Plan as recited in claim 16 wherein the objective function for the Figure of Merit for candidate Field Development Plans is degraded by a risk factor, and the system further comprises means for providing a risk aversion factor into the system.

21. A system for automatically generating a Field Development Plan as recited in claim 16 further comprising means for determining whether an amount of uncertainty computed for a risk-based Figure of Merit calculation for a Field Development Plan is within acceptable limits.

* * * * *